US006527063B2

(12) United States Patent
Rust et al.

(10) Patent No.: US 6,527,063 B2
(45) Date of Patent: Mar. 4, 2003

(54) DIRECTIONAL BORING DEVICE

(76) Inventors: Wendall D. Rust, 7817 County Line Rd., Bourbon, IN (US) 46504; Marv Selge, Jr., 2833 S. 11th St. (US 33), Niles, MI (US) 49120-4421

( * ) Notice: Subject to any disclaimer, the term of this patent is extended or adjusted under 35 U.S.C. 154(b) by 0 days.

(21) Appl. No.: 09/788,144

(22) Filed: Feb. 16, 2001

(65) Prior Publication Data

US 2002/0014352 A1 Feb. 7, 2002

Related U.S. Application Data

(60) Provisional application No. 60/183,206, filed on Feb. 17, 2000.

(51) Int. Cl.[7] ..... E21B 7/04
(52) U.S. Cl. ..... 175/162; 173/25; 173/193
(58) Field of Search ..... 175/61, 121, 122, 175/162; 173/25, 193

(56) References Cited

U.S. PATENT DOCUMENTS

| | | | | |
|---|---|---|---|---|
| 4,047,582 A | * | 9/1977 | Appleman | |
| 4,813,499 A | * | 3/1989 | McNulty | |
| 4,953,638 A | | 9/1990 | Dunn | 175/61 |
| 4,998,590 A | | 3/1991 | Wells | 175/162 |
| 5,090,486 A | | 2/1992 | Jones | 173/26 |
| 5,139,097 A | * | 8/1992 | Rajala | |
| 5,213,169 A | * | 5/1993 | Heller | |
| 5,226,488 A | * | 7/1993 | Lessard et al. | |
| 5,363,925 A | * | 11/1994 | Gallagher | |
| 5,556,217 A | | 9/1996 | Deyo et al. | 403/61 |
| 5,592,993 A | | 1/1997 | Parish, II et al. | 175/162 |
| 5,662,176 A | | 9/1997 | Madgwick et al. | 175/185 |
| 5,778,991 A | | 7/1998 | Runquist et al. | 175/61 |
| 5,803,189 A | | 9/1998 | Geldner | 175/113 |
| 5,810,101 A | | 9/1998 | Caraway, Jr. et al. | 175/78 |
| 5,868,211 A | | 2/1999 | Bohn | 175/170 |
| 5,873,421 A | | 2/1999 | Assenza | 175/121 |
| 5,941,320 A | | 8/1999 | Austin et al. | 175/27 |
| 5,944,121 A | | 8/1999 | Bischel et al. | 175/24 |
| 6,179,068 B1 | * | 1/2001 | West | |
| 6,237,703 B1 | * | 5/2001 | Draney et al. | |

* cited by examiner

*Primary Examiner*—Roger Schoeppel
(74) *Attorney, Agent, or Firm*—E. Victor Indiano, Esq.; Indiano, Vaughan & Roberts, P.A.

(57) ABSTRACT

A directional boring device is provided for attachment to a carrier having a power source for providing a first power supply to the boring device for moving the device and a second power supply for operating the device. The boring device includes an attachment frame, and a selectively attachable first coupler for coupling the attachment frame to the first power supply to permit movement of the device. A drill tool assembly is provided that includes a drill head, a drill stem attachable to the drill head, a drill bit attachable to the drill stem and a drill assembly power transmission. The drill assembly power transmission imparts rotational and axial movement to the drill tool assembly whereby the drill assembly transmission is capable of moving the drill head and drill stem in a path generally parallel to the plane on which the carrier rests. A selectively attachable second coupler is provided for coupling the second power supply to the drill assembly power transmission for permitting the carrier power source to supply power to the drill assembly power transmission to operate the drill tool assembly.

15 Claims, 33 Drawing Sheets

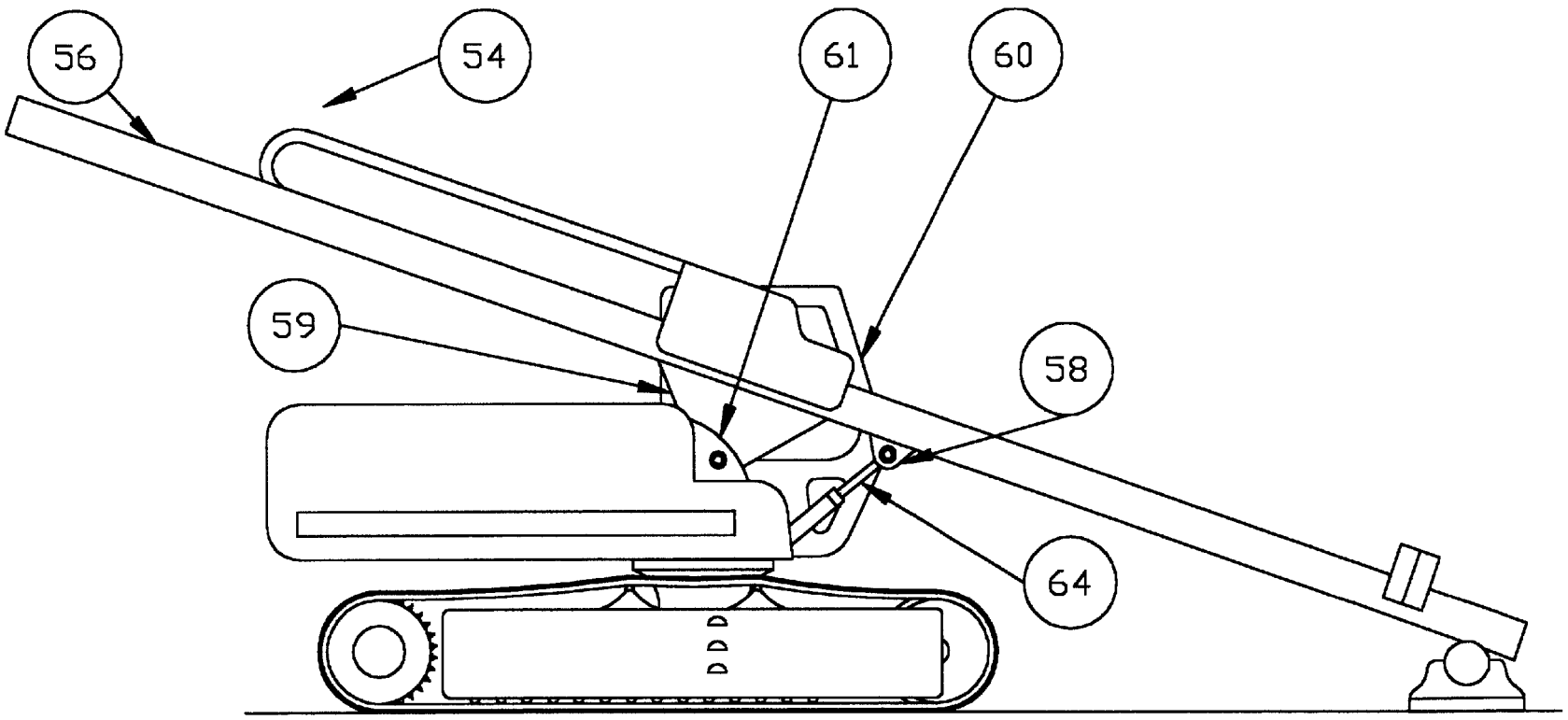
FIG. #4b

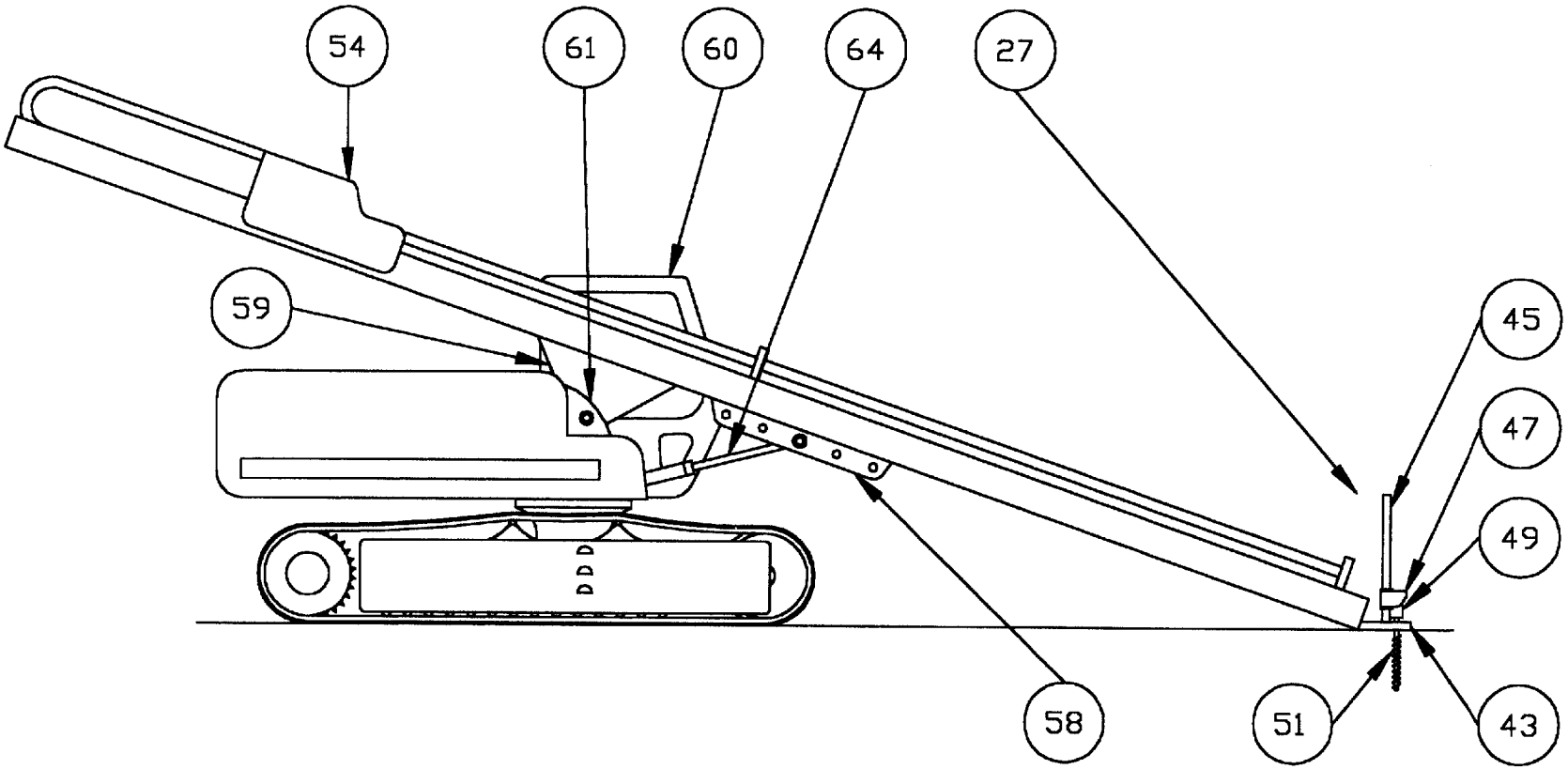
FIG. #5

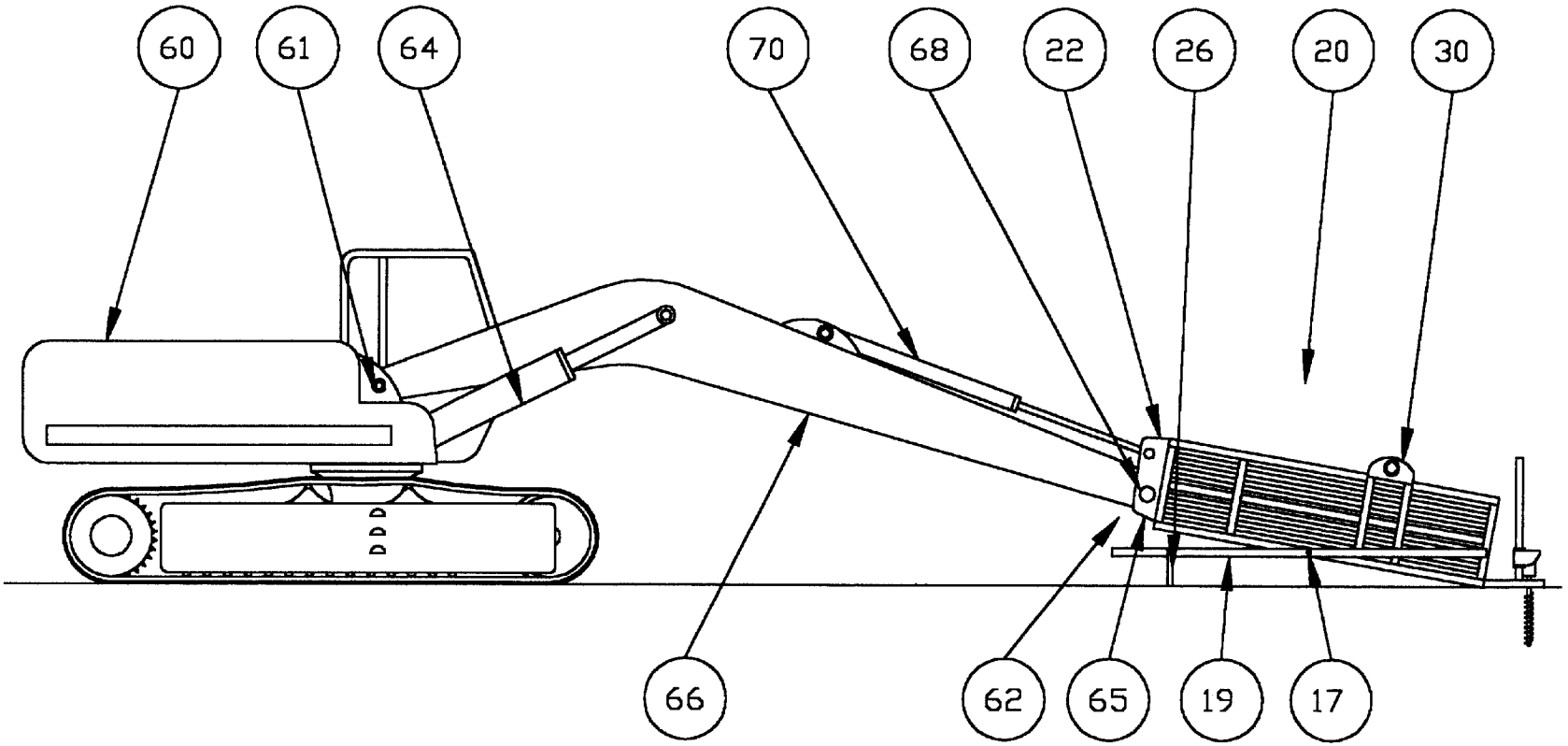
FIG. #6

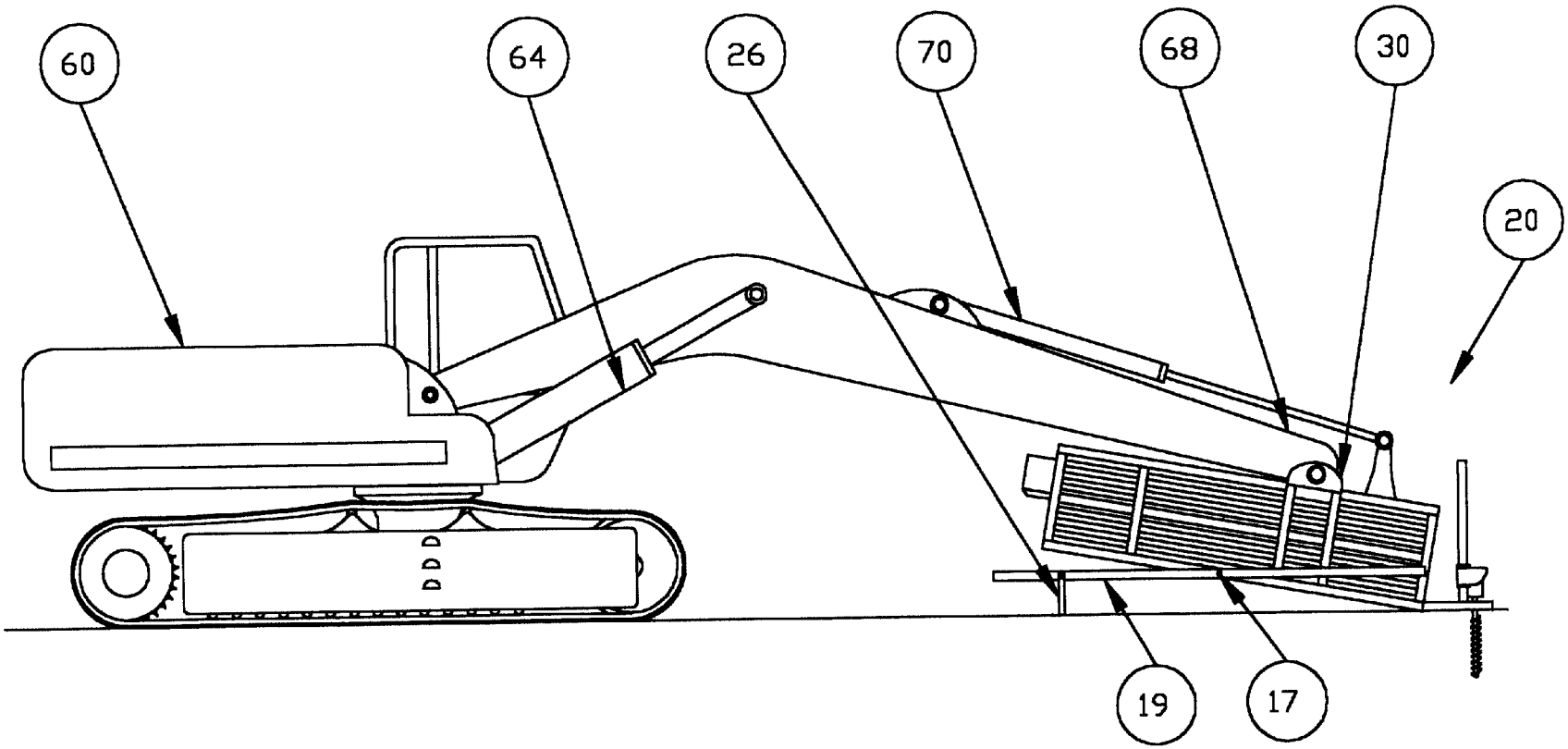
FIG. #7

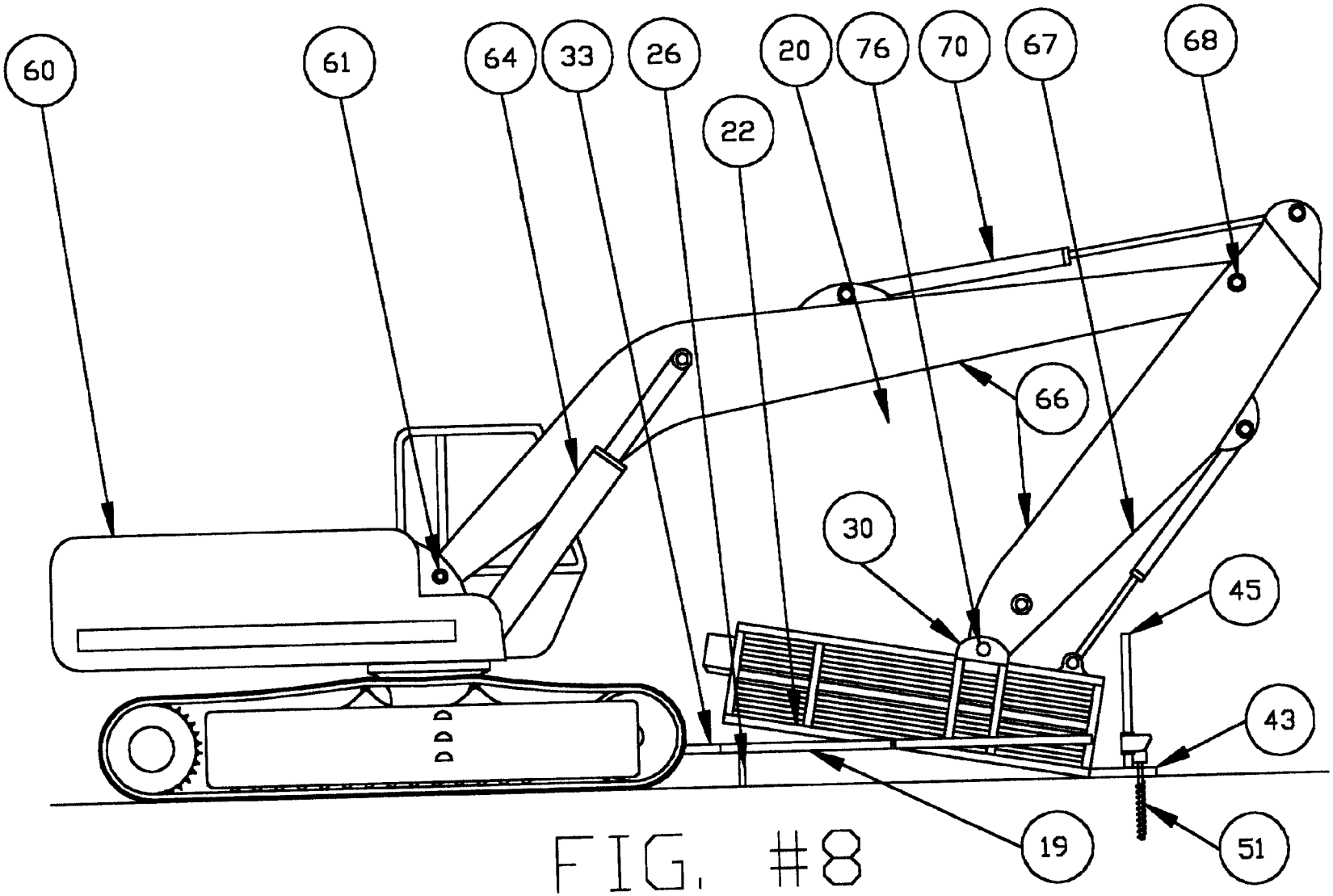
FIG. #8

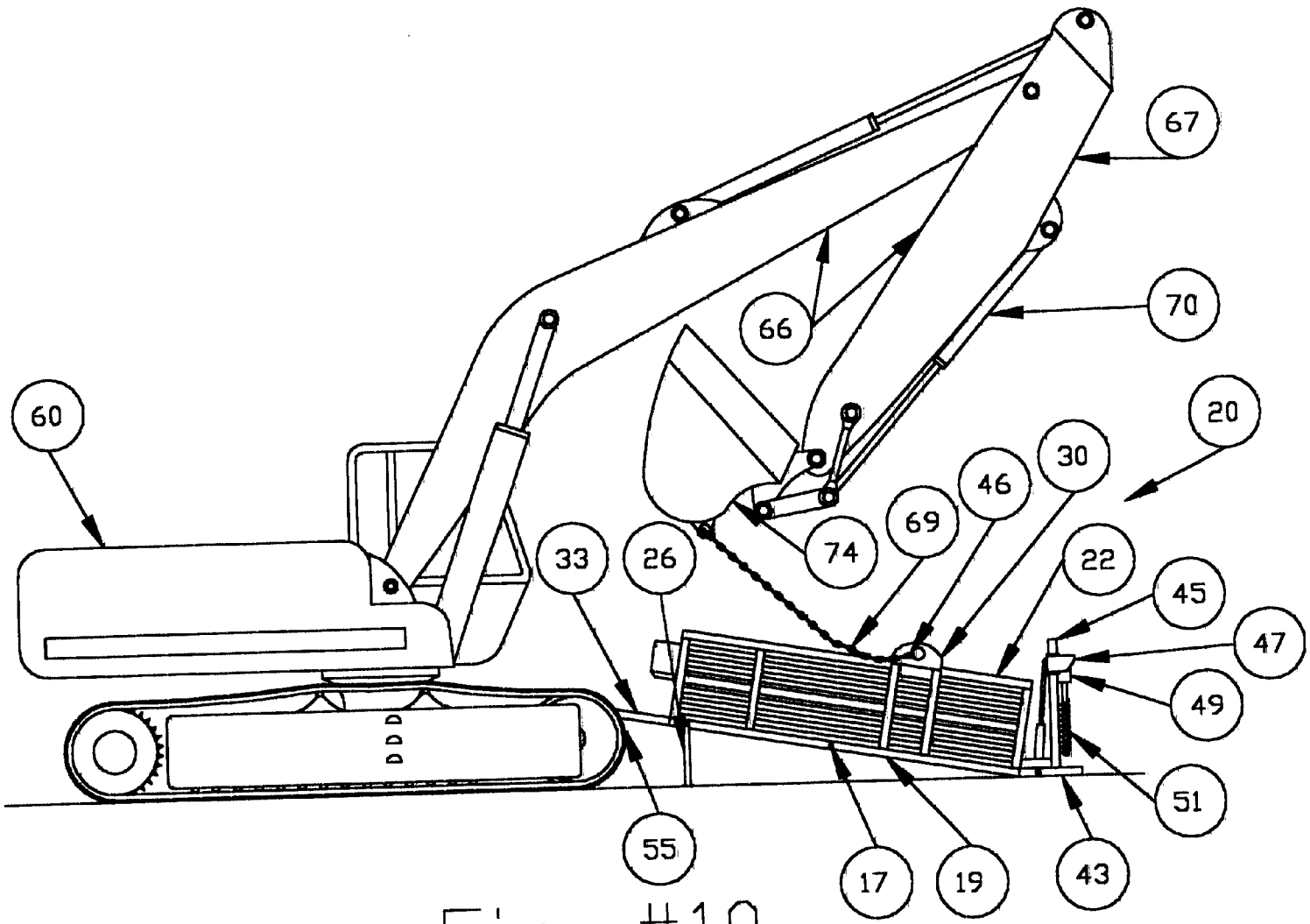
Fig. #10

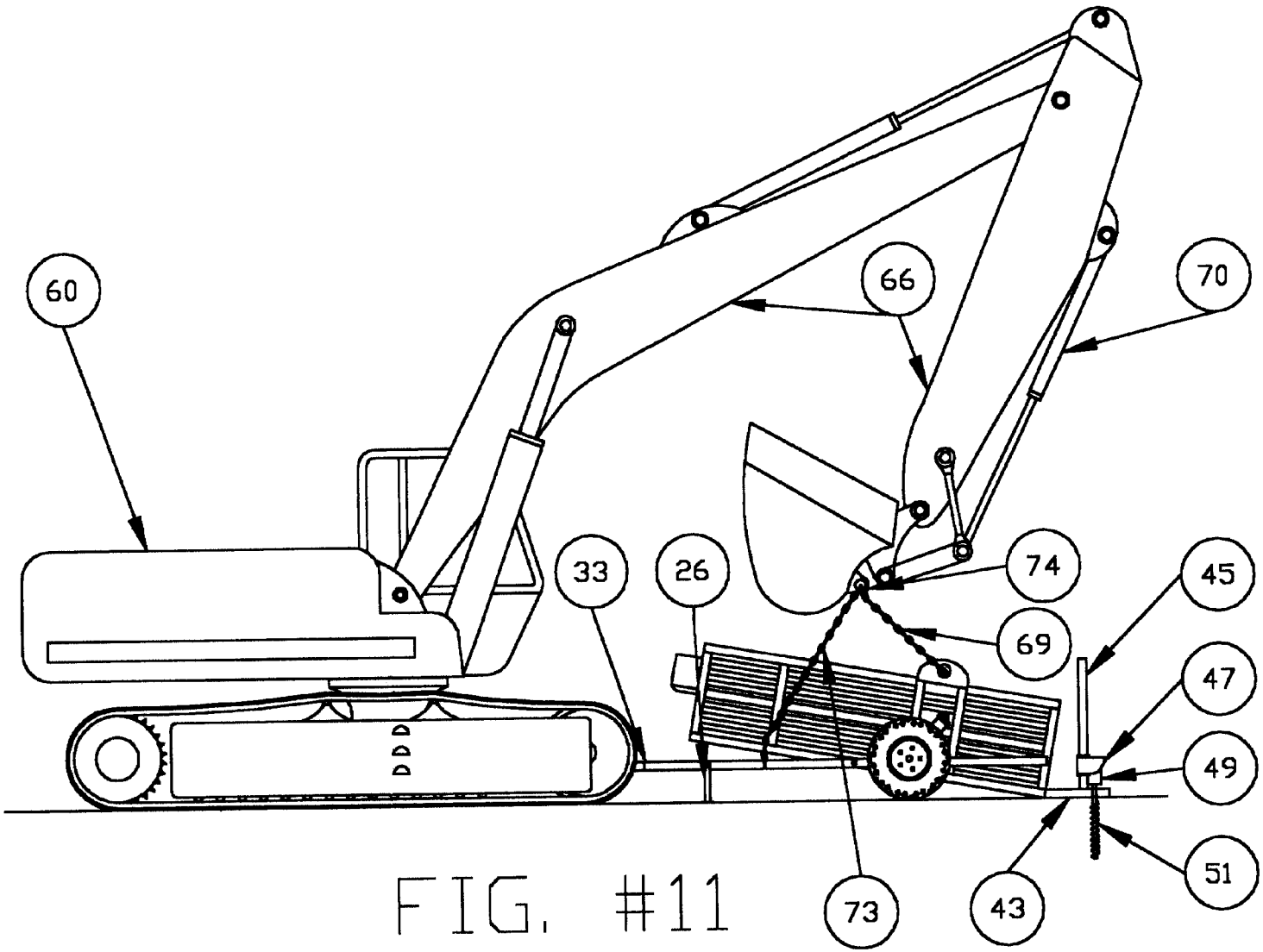
FIG. #11

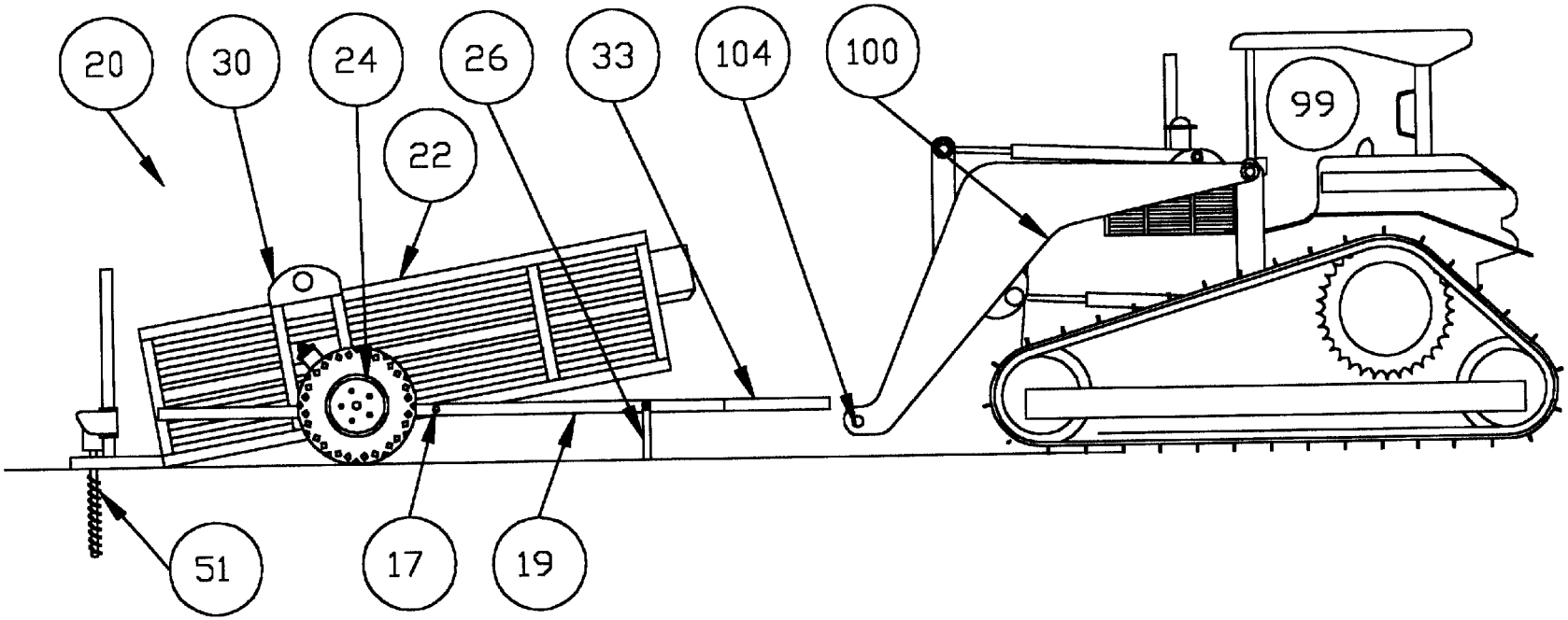
FIG. #12

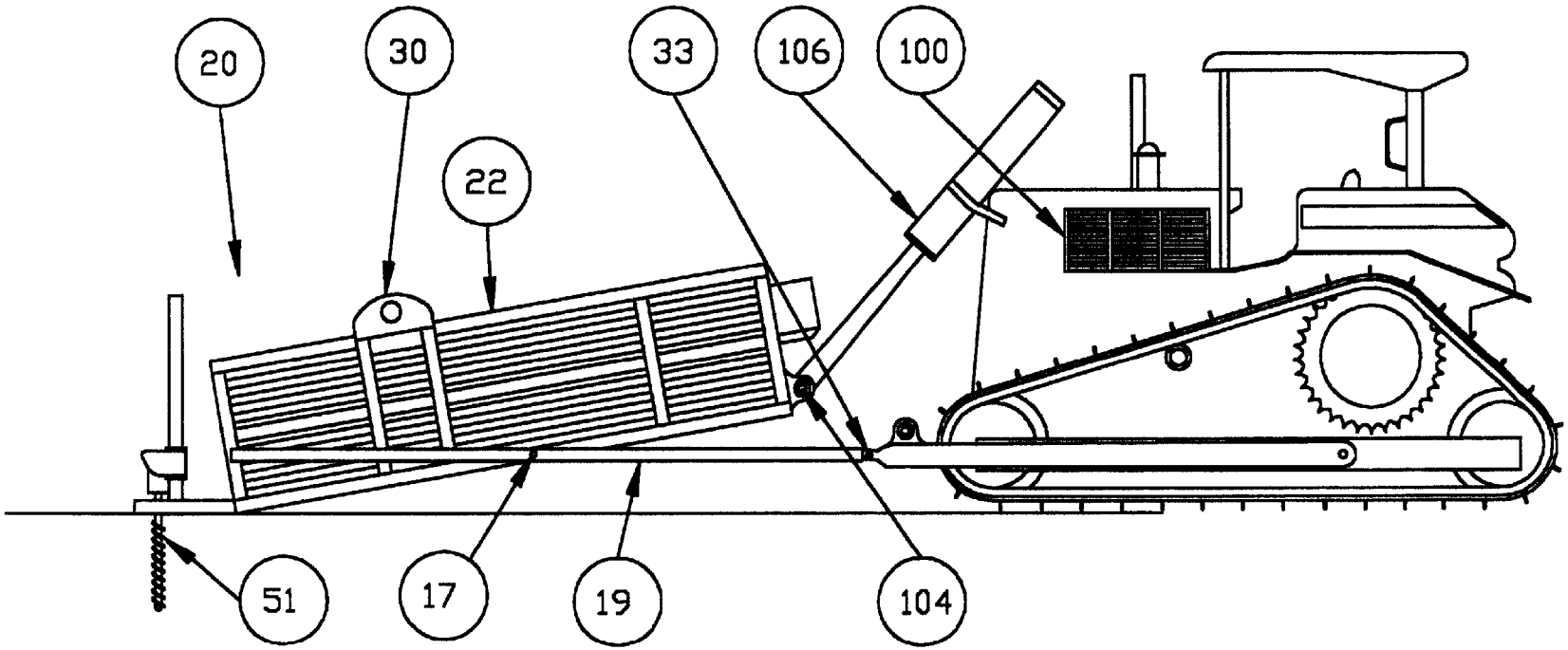
FIG. #13

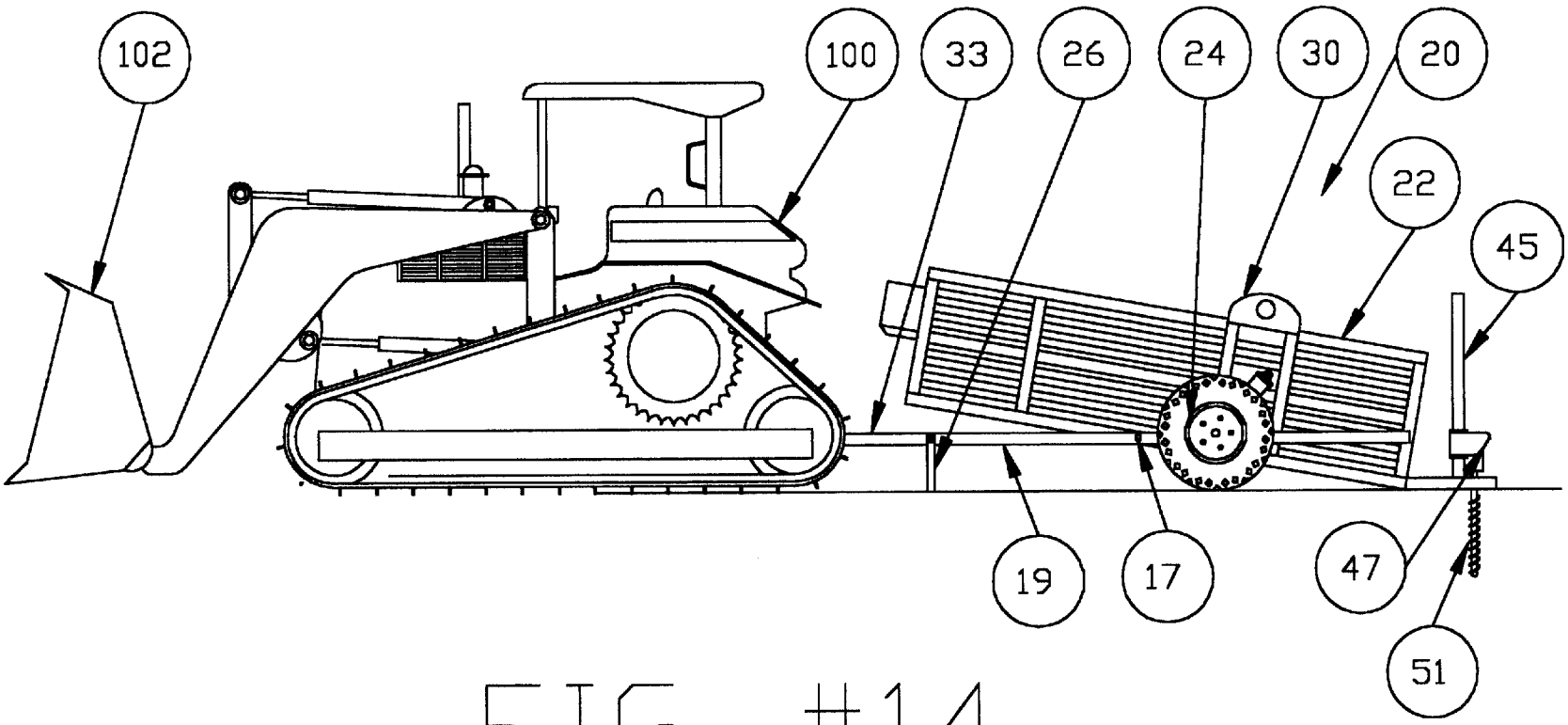
FIG. #14

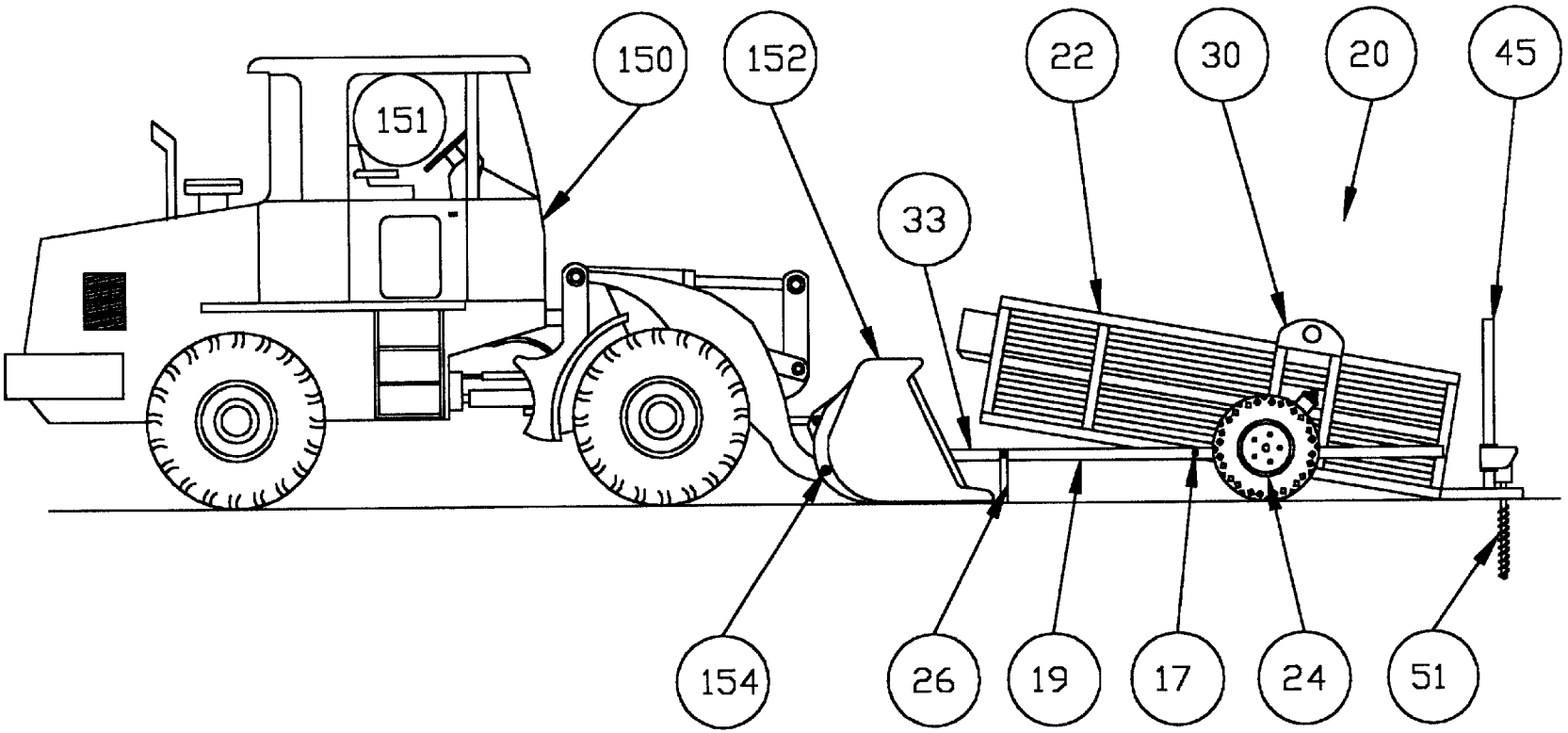
FIG. #15a

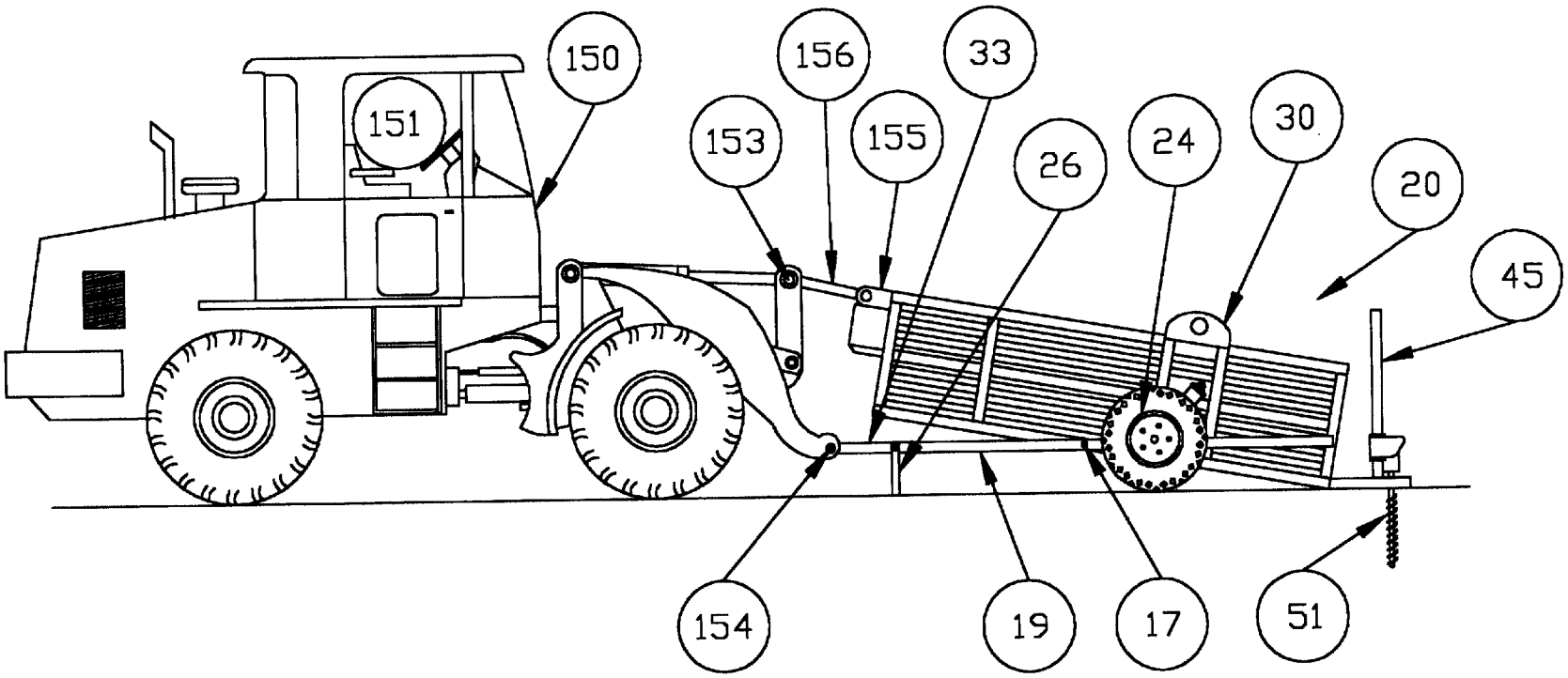
FIG. #15b

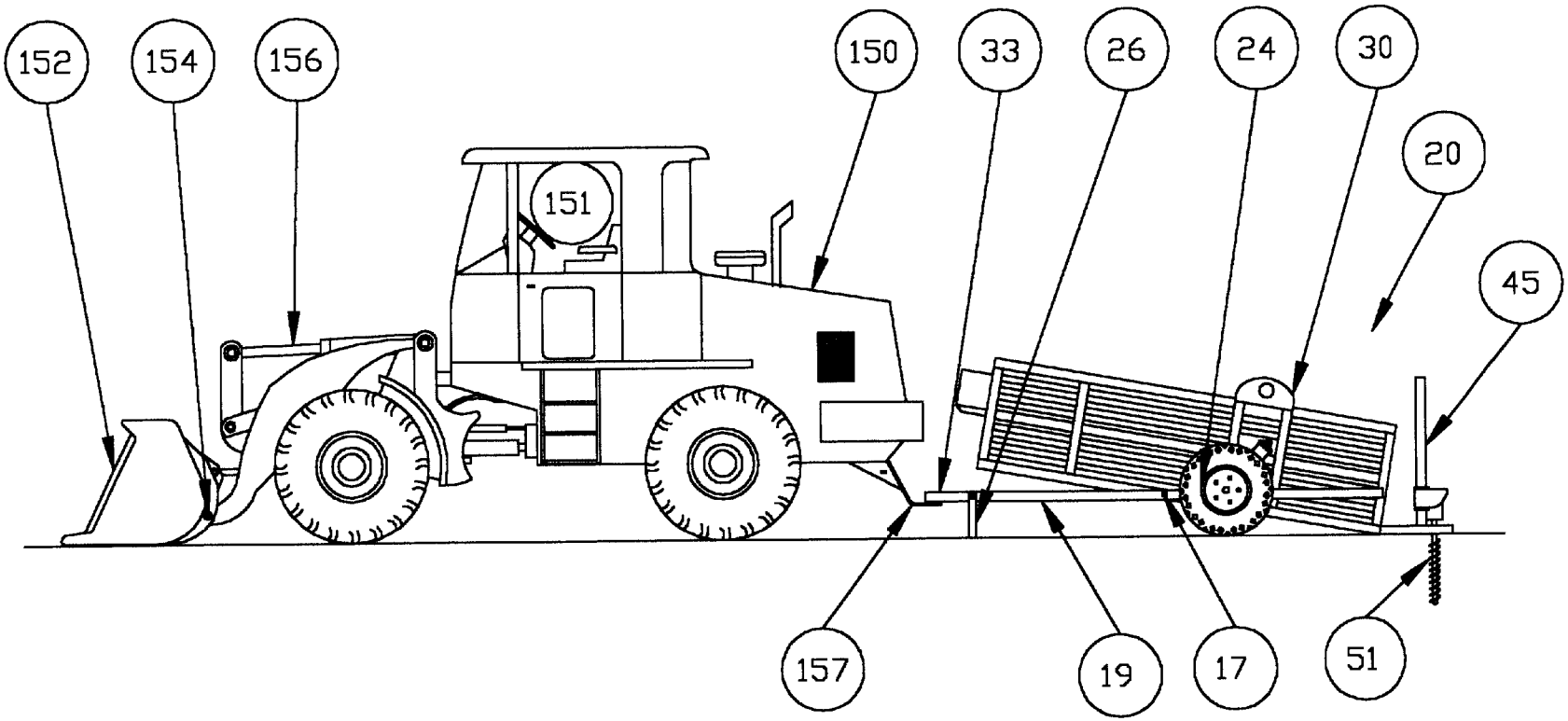
FIG. #16

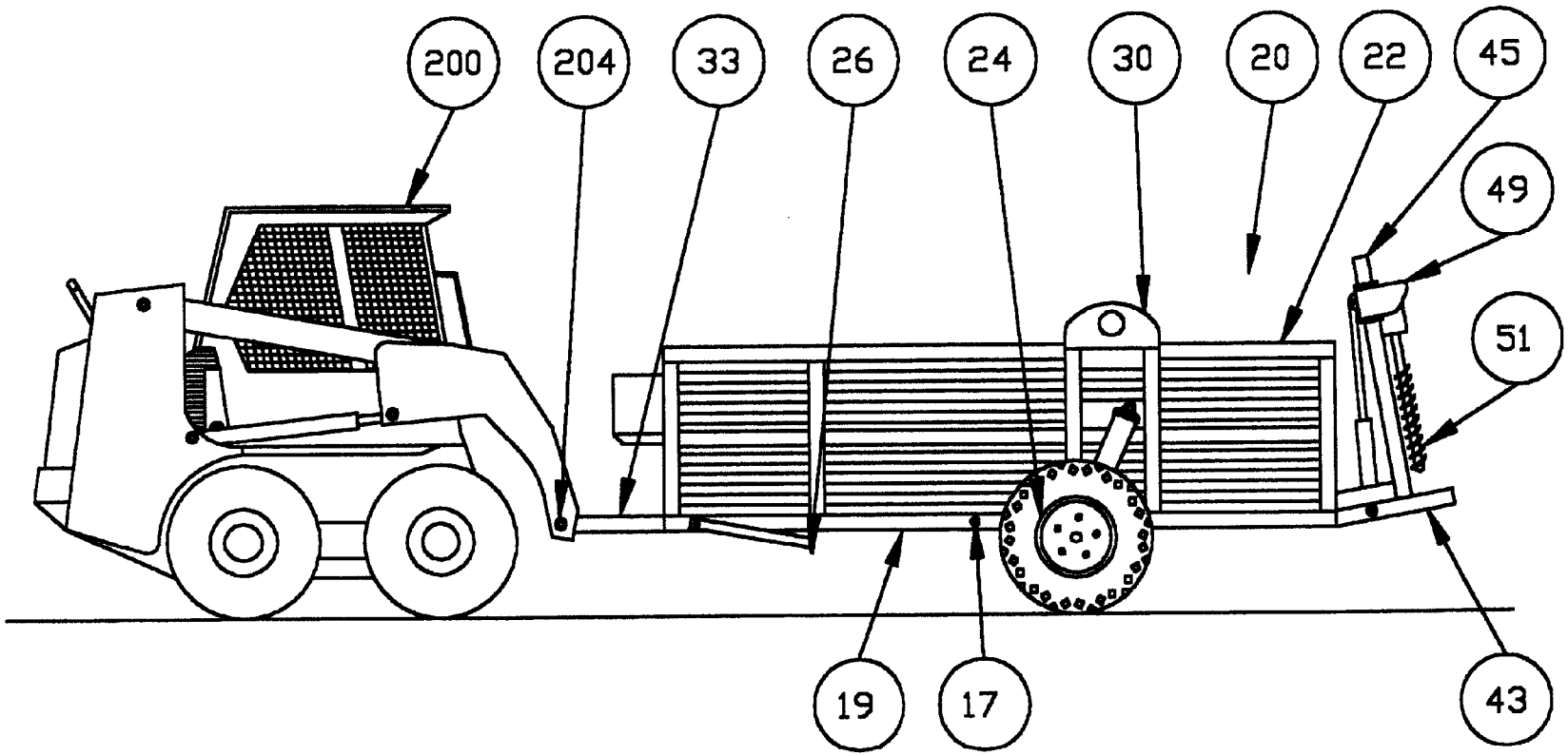
FIG. #17

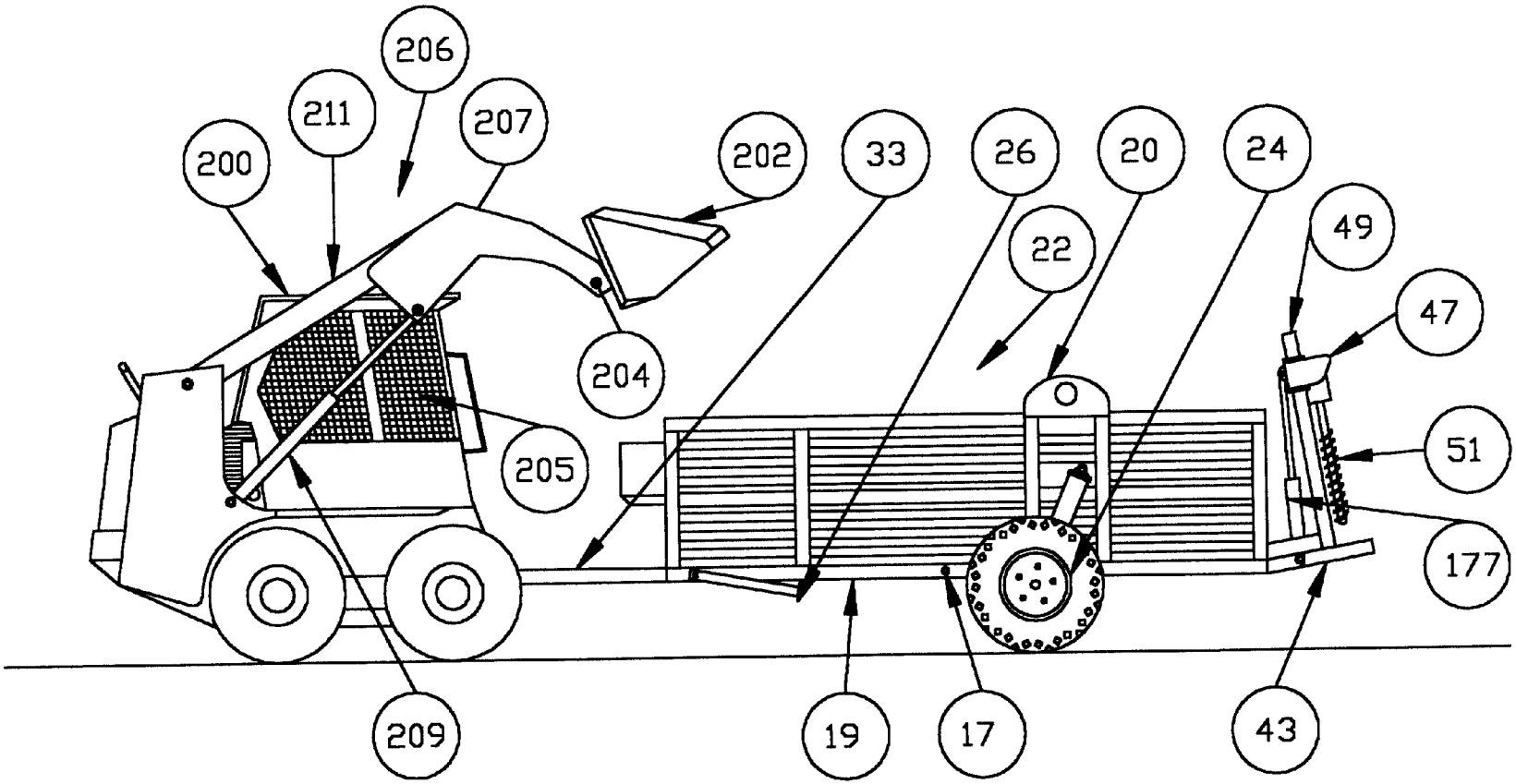
FIG. #18

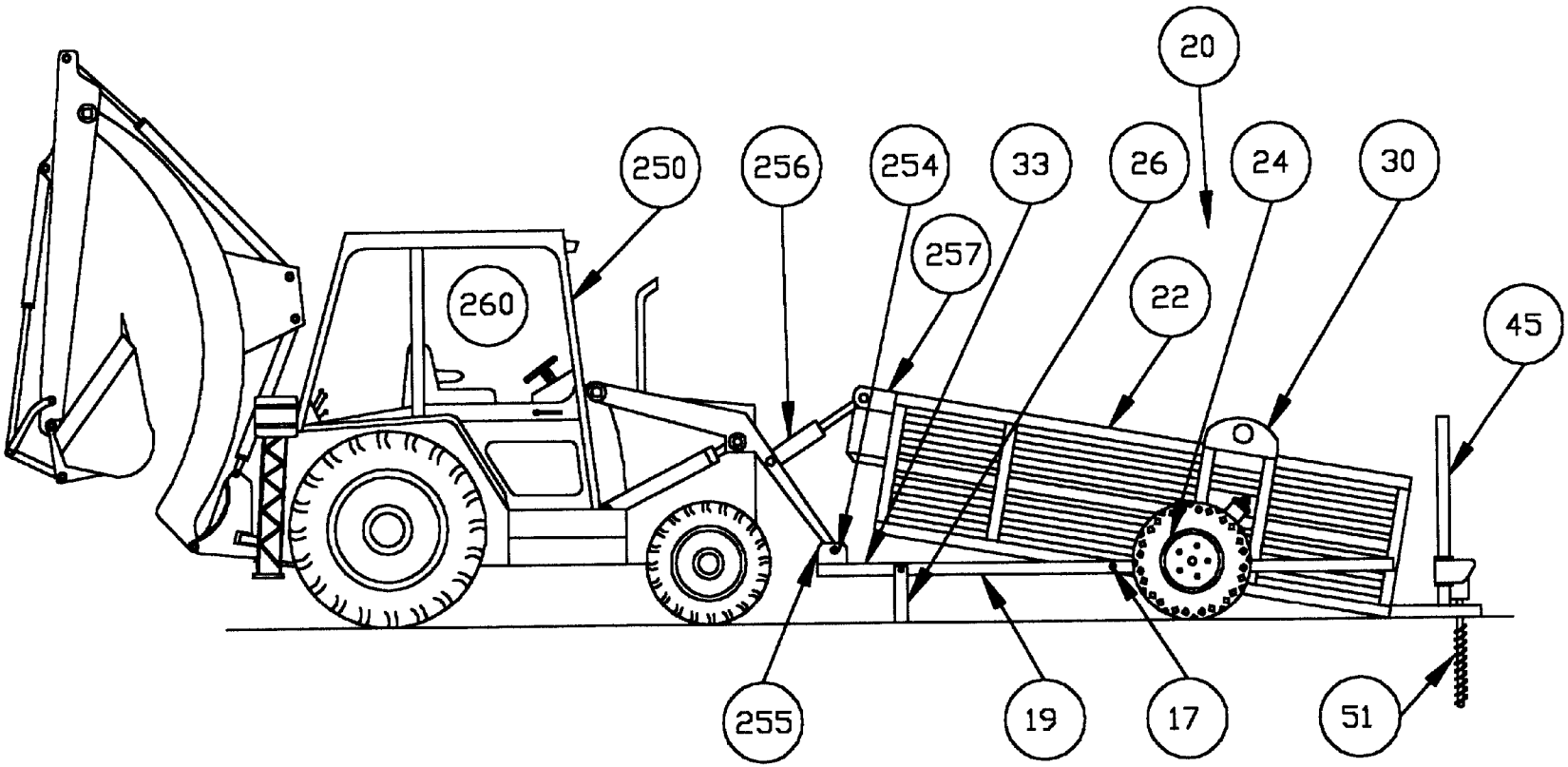
FIG. #19

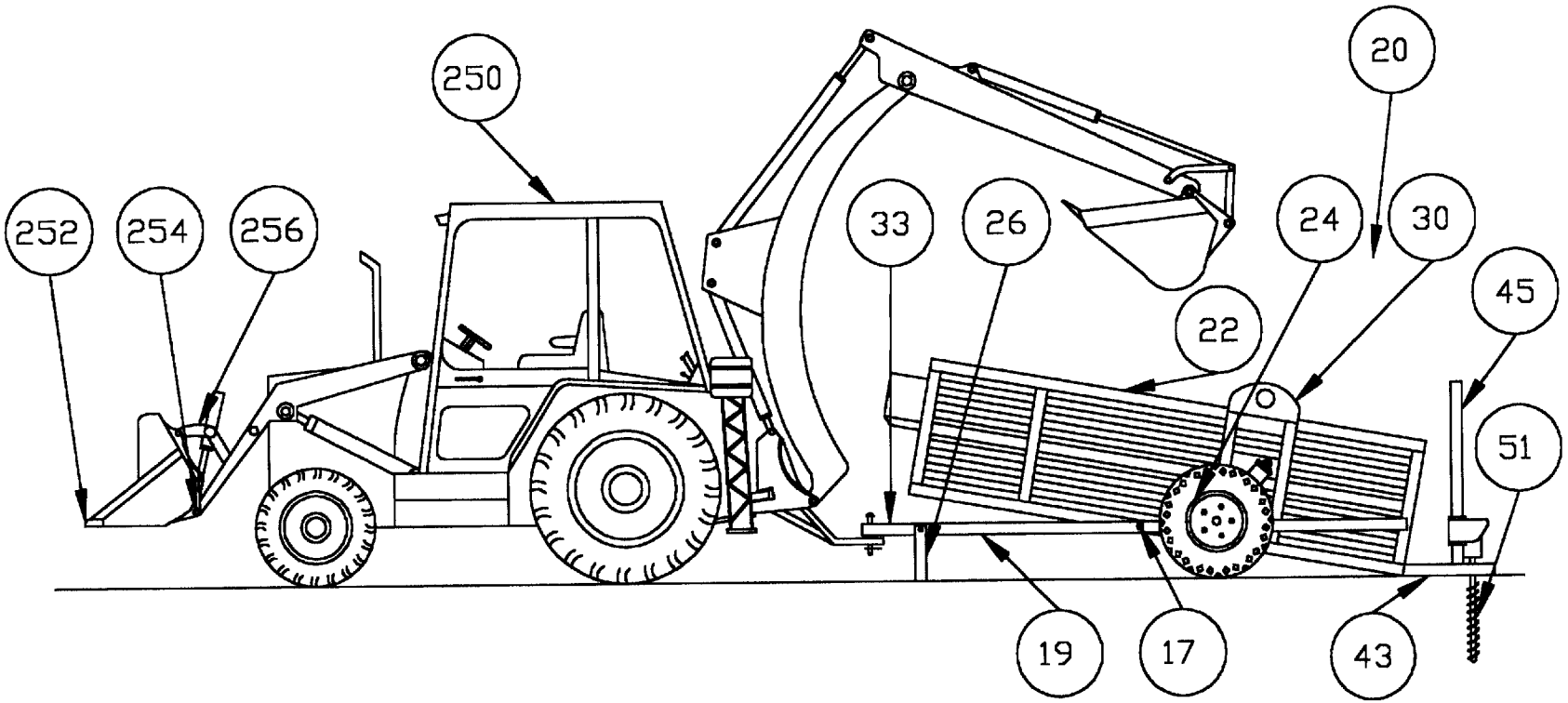
FIG. #20

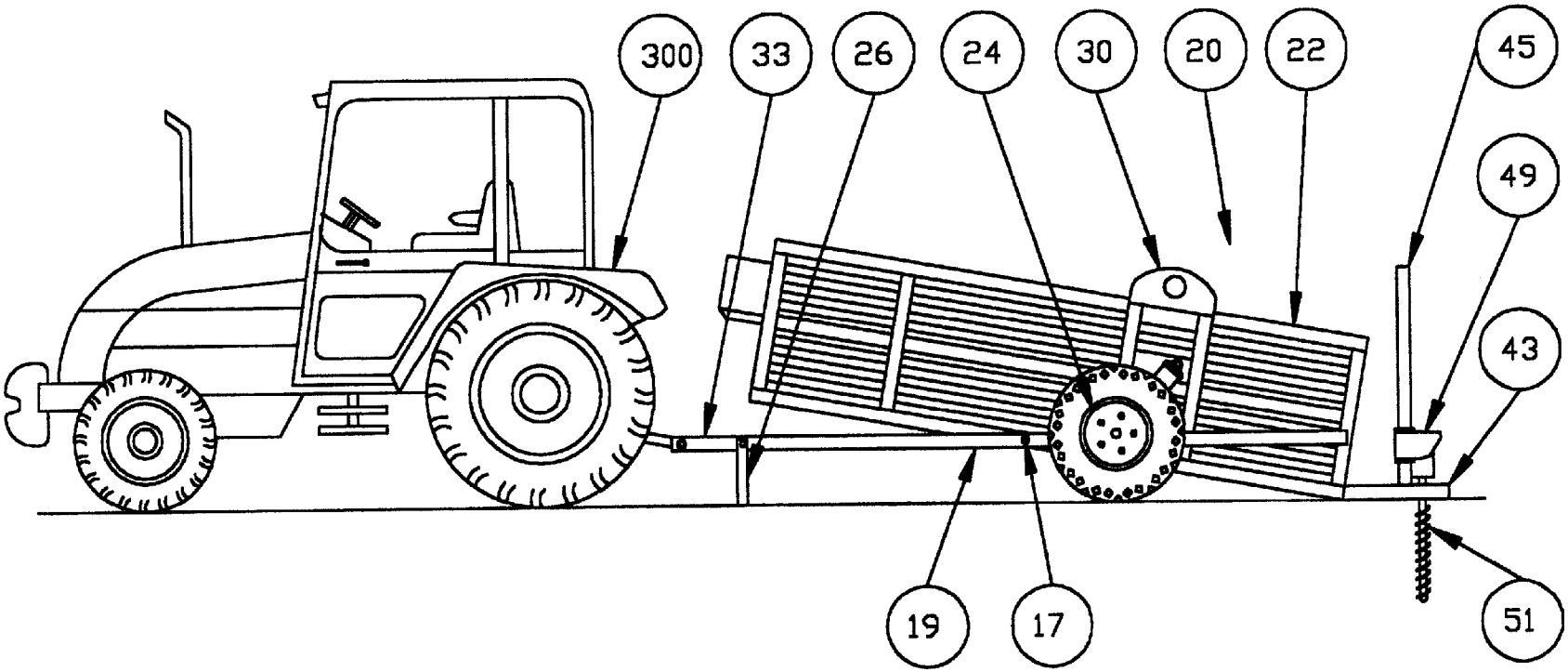
FIG. #21

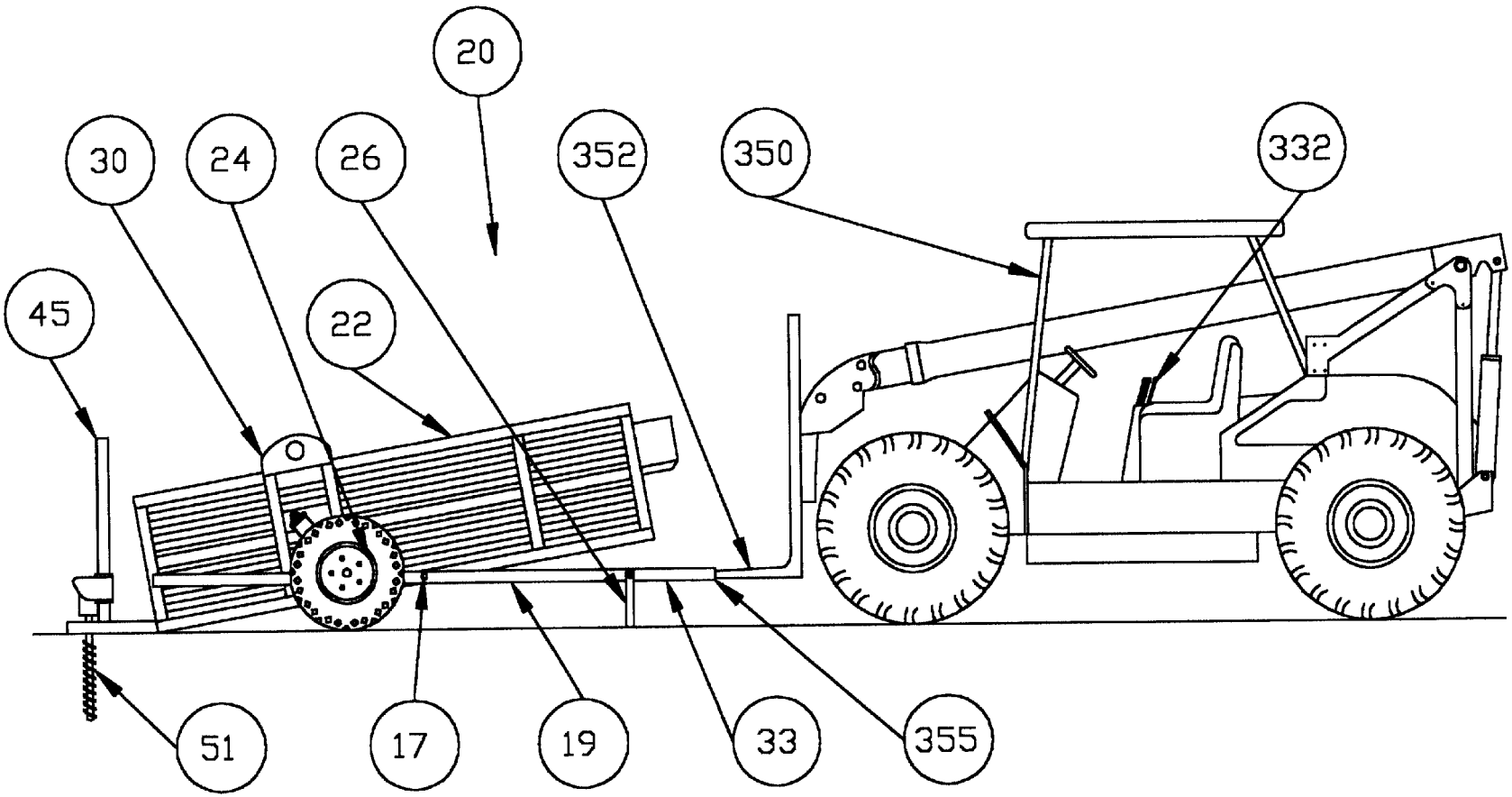
FIG. #22

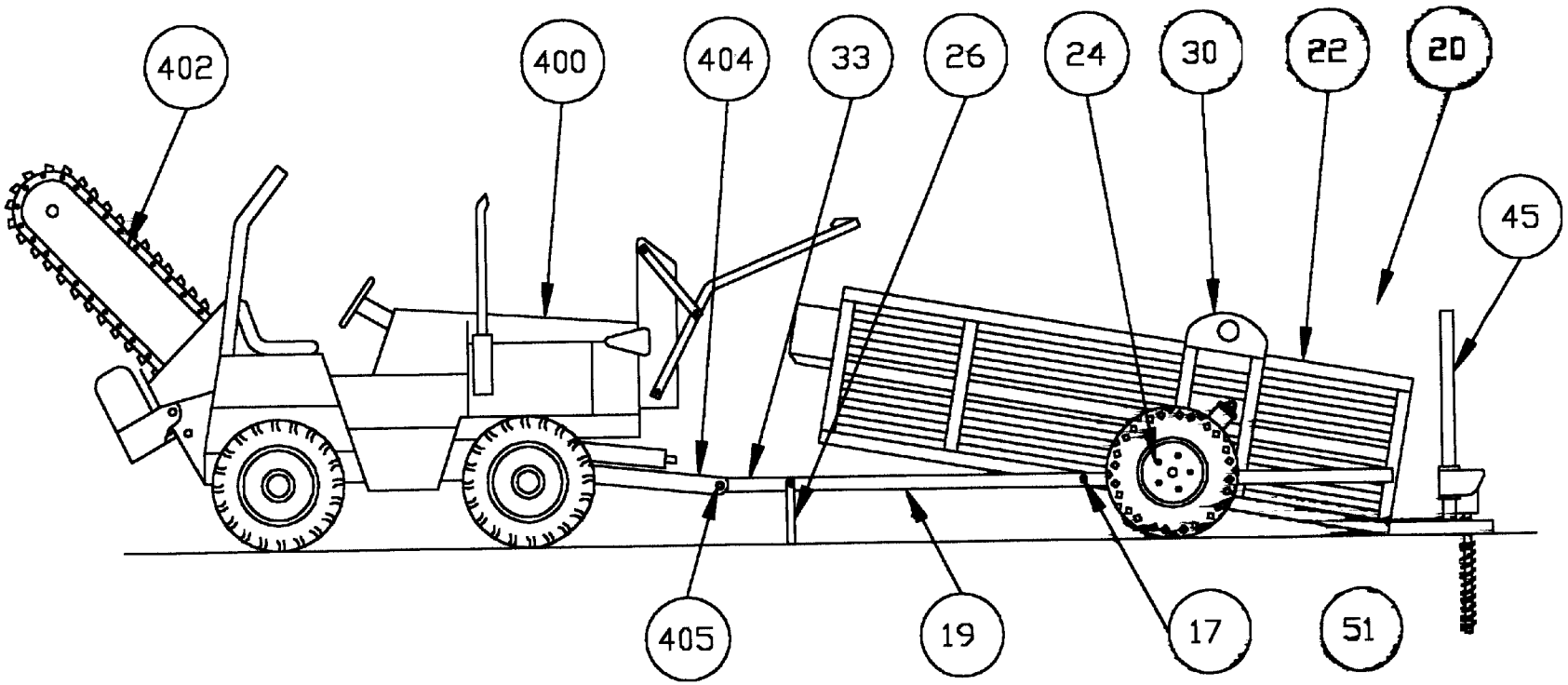
FIG. #23

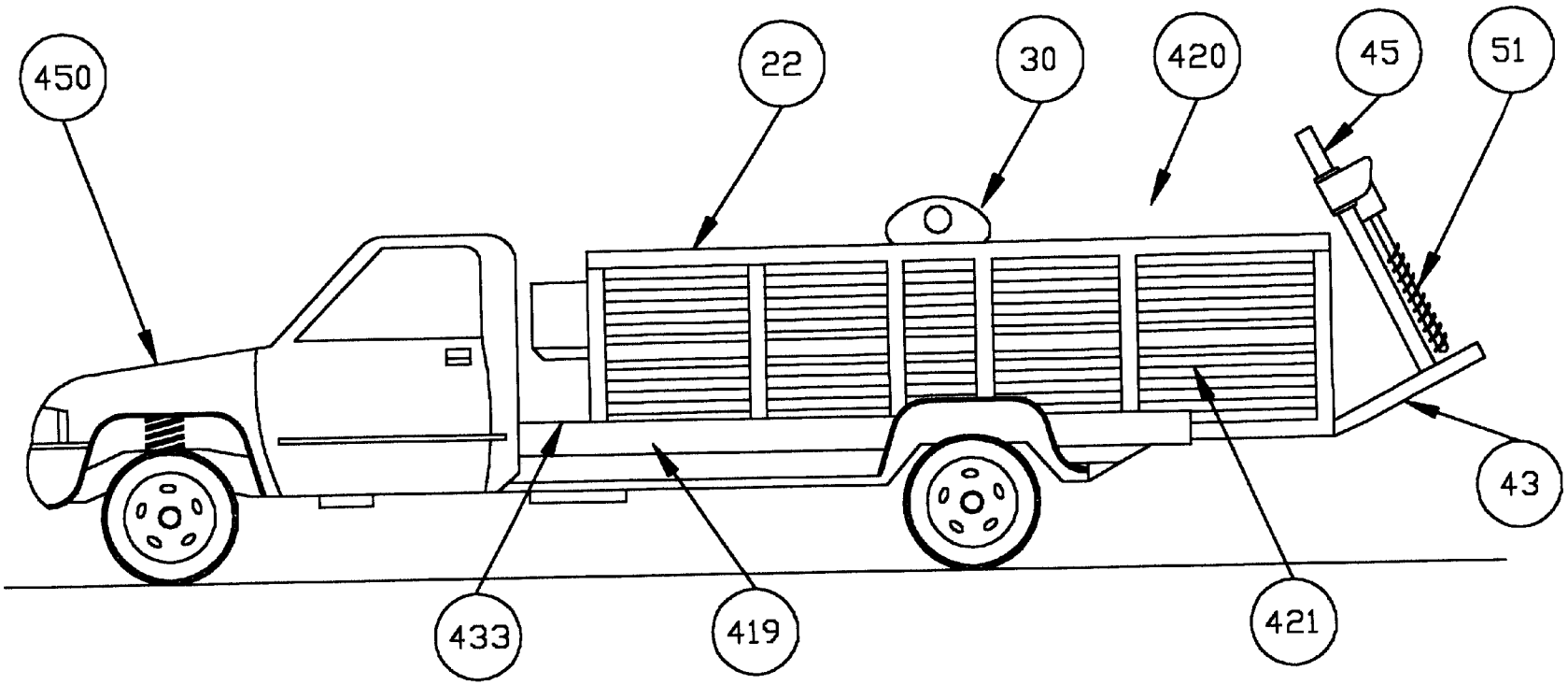
FIG. #24a

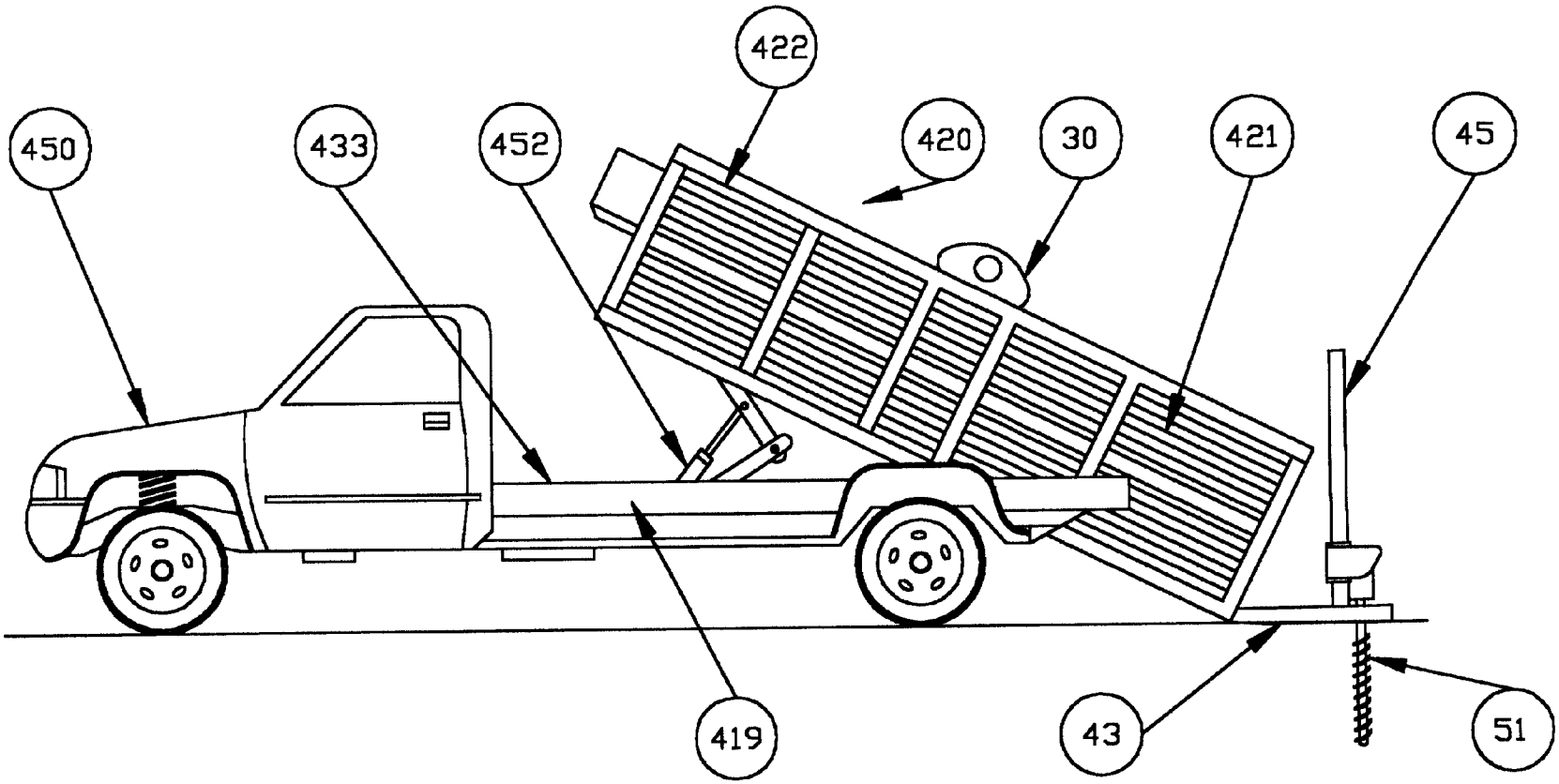
FIG. #24b

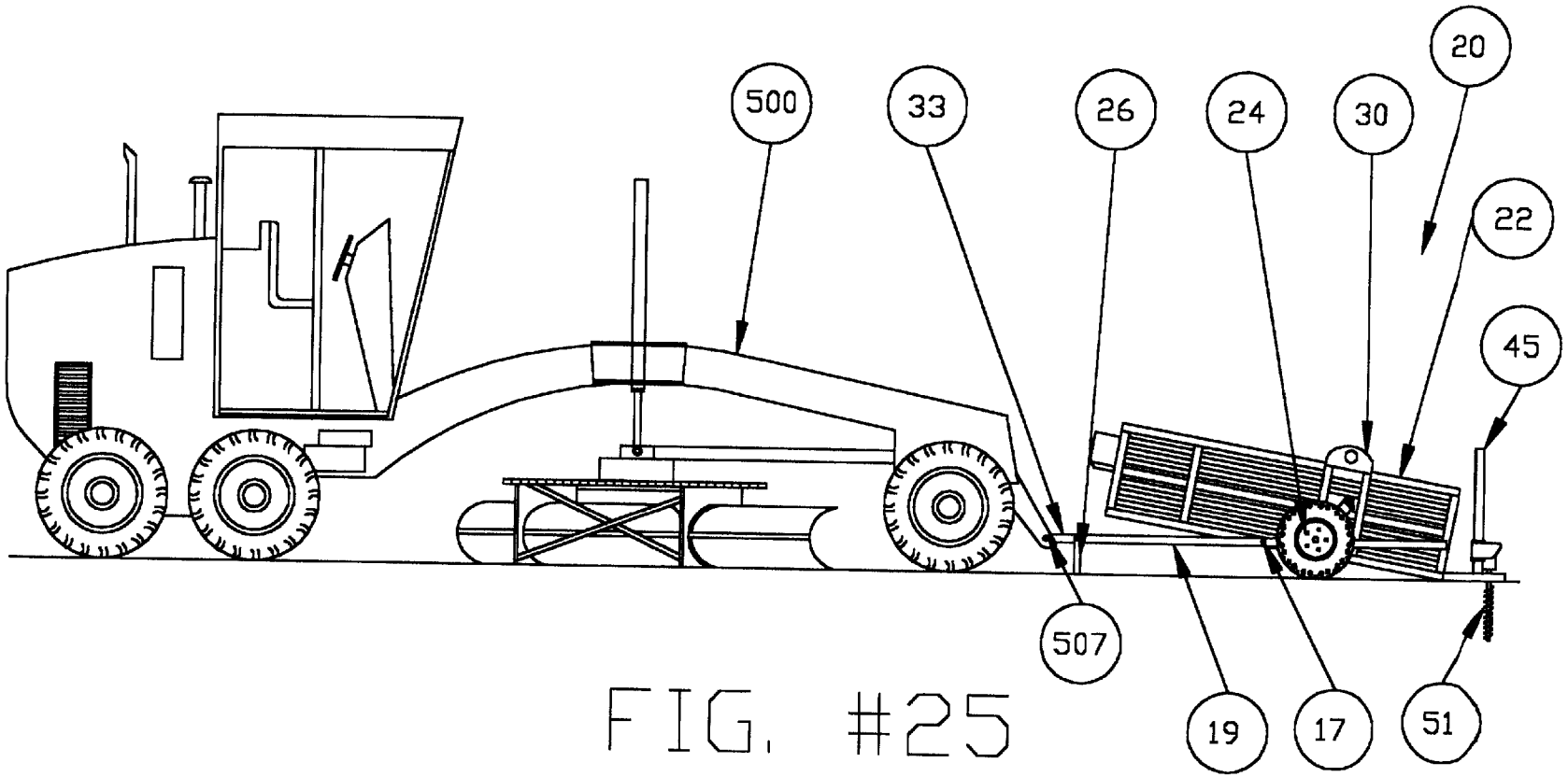
FIG. #25

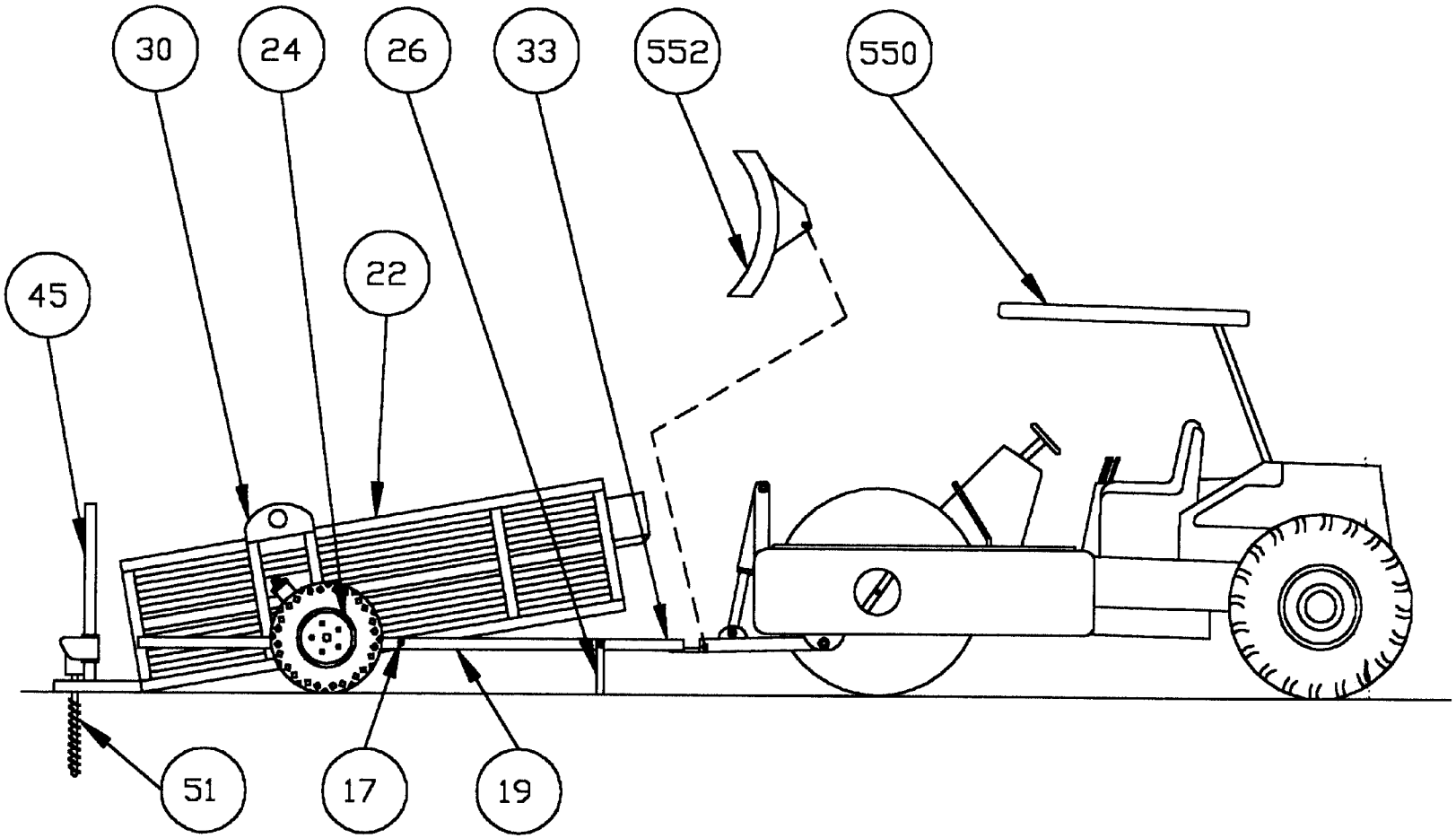
FIG. #26

DIRECTIONAL BORING DEVICE

STATEMENT OF PRIORITY

This patent application claims priority to United States Provisional Patent Application No. 60/183,206, filed on Feb. 17, 2000.

TECHNICAL FIELD OF THE INVENTION

The invention relates to directional boring machines, and more particularly to a directional boring attachment for boring through the earth in order to lay utility lines, such as gas lines, electrical conduit, communications conduit, sewer lines, and water lines.

BACKGROUND OF THE INVENTION

Utility lines for water, electricity, gas, telephone and cable television are often run underground for reasons of safety and aesthetics. In many situations, the underground utility pipes, cables, and lines (collectively, "utility lines") can be buried in an open trench. After the utility lines are buried, the trench is then back-filled to bring it up to grade. Although useful in areas of new construction, the burial of utility lines in an open trench in already developed areas has certain disadvantages. In previously, partially, or fully developed areas, the digging and existence of a trench can cause serious disturbance to structures or roadways. Further, digging a trench in previously developed areas creates a high risk of damaging previously buried utility lines. Another problem with digging an open trench is that structures or roadways disturbed by such digging are rarely restored to their original condition. Furthermore, a trench poses a danger of injury caused by workers or other persons inadvertently falling into the trench, or the collapse of the trench upon people working in the trench.

The general technique of boring a horizontal underground tunnel in which utility lines are placed has recently been developed in order to overcome the disadvantages described above, as well as others associated with conventional trenching techniques. Conventional directional boring machines typically include an elongated boom having a drill head that moves longitudinally forward and rearward over the length of the boom. The boom is angled relative to the surface (usually the ground) to be drilled at an angle ranging from 5° to 25°. The drill head includes a rotating spindle, generally driven by a hydraulic motor, to which one or more elongated drill stems (also referred to as "casings") are detachably connected.

Conventional directional boring machines operate by connecting the proximal end of a first drill stem to the rotating spindle of the drill head and connecting a drill bit to the opposite or outer (distal) end. With the drill head in a retracted position on the boom, spindle rotation begins and the drill head is advanced axially and distally down the boom resulting in the drilling of a bore. When the drill head reaches the outer (distal) boom end, the proximal end of the drill stem is detached from the drill head spindle and the drill head is retracted to its original position. The proximal end of a second drill stem is then mounted to the spindle with the distal end of the drill stem being connected to the proximal end of the existing first drill stem. The drilling process then continues until the drill head again reaches the distal end of the boom, and the process is repeated.

The drill stems are typically cylindrical in configuration with hollow interiors to permit the flow therethrough of a drilling lubricant that is discharged through the drill bit at the point of drilling. The drill stems are also relatively rigid, and the bore that is being drilled initially extends linearly at an inclined angle that corresponds to the angle of the boom. The angle of attack of the drilling may be altered so that when a desired depth is reached, the drilling operation is changed to progress generally horizontal, or otherwise parallel with the surface of the ground. When the underground bore has reached its desired length, the drill bit can be directed to be angled upwardly until the drill bit re-emerges at the ground surface. This point of emergence then forms the opposite end of the drilled bore hole or tunnel.

Many conventional directional boring machines include an electronic transmitter in the drill bit that aids in tracking both the depth and the ground-relative position of the drill bit After the drill bit reemerges at the ground surface, a reamer is typically attached to the drill bit which is retracted axially backwardly through the borehole, thus reaming out the borehole to achieve a larger diameter borehole. A utility line is commonly attached to the reamer prior to pulling the drill stem and drill bit back through the borehole so that the utility line or conduit is retracted back through the borehole along with the reamer.

Due in part to the minimal impact that directional boring machines have on the surrounding environment, directional boring machines have largely replaced other industrial trenching machines (such as back-hoes and power shovels) for laying utility lines, and have reduced the need for such industrial trenching machines. Despite the reduced need for these other trenching machines, many contractors already have amassed a sizable fleet of such equipment. Due to the current preference for new directional boring machines, these open trench-type trenching machines sit idle for a significant percentage of time, thus being significantly under-utilized. Moreover, despite these old style trench-type trenching machines sitting idle for a significant percentage of time, contractors are unable to completely remove them from their fleets, because they are still useful for performing other types of operations, such as excavating basements of houses and other buildings. Accordingly, there is a need for a method and apparatus that enables contractors to better utilize their fleet of industrial machines Directional boring machines currently available in the marketplace typically include treads or wheels that are driven by an on-board engine, thus enabling the directional boring machine to be moved and maneuvered under its own power. Furthermore, these directional boring machines typically include on-board power supplies such as hydraulic pumps or alternators that are driven by the on-board engine. The conventional direction boring machines utilize the on-board power supply both to rotate, tilt and axially move the drill stem and drill bit. Unfortunately, the on-board engine, power supplies, and powered treads or wheels cause conventional directional boring machines to be relatively expensive to acquire or lease. Accordingly, many small contractors simply cannot afford to maintain a fleet of conventional directional boring machines, despite the advantages of directional boring techniques over trench Therefore, a need exists for a directional boring apparatus that is less expensive than conventional directional boring machines.

SUMMARY OF THE INVENTION

In accordance with the present invention, a directional boring device is provided for attachment to a carrier having a power source for providing a first power supply to the boring device for moving the device and a second power supply for operating the device. The boring device comprises an attachment frame, and a selectively attachable first coupler for coupling the attachment frame to the first power supply to permit movement of the device. A drill tool assembly is provided that includes a drill head, a drill stem attachable to the drill head, a drill bit attachable to the drill stem and a drill assembly power transmission. The drill assembly power assembly transmission is capable of moving the drill head and drill stem in a path generally parallel to the plane on which the carrier rests. A selectively attachable second coupler is provided for coupling the second power supply to the drill assembly power transmission for permitting the carrier power source to supply power to the drill assembly power transmission to operate the drill tool assembly.

The present invention addresses the above-identified needs, as well as others, with a directional boring apparatus suitable for being used as an attachment with various new or existing types of carrier bodies such as hydraulic excavators, track-type tractors/dozers, standard wheel loaders, articulating wheel loaders, skid loaders, backhoe loaders, agricultural-type tractors, powered industrial trucks, forklifts, trenching machines, trucks, road graders, and roller compactors. Typical carrier bodies include power units such as steering mechanisms, track assemblies, wheel assemblies, internal combustion engines, transmissions, hydraulic systems, hydraulic pumps, electrical systems, batteries, and alternators.

By configuring the directional boring apparatus as an attachment that utilizes power supplied by separate powered carrier bodies, the directional boring attachment of the present invention eliminates a large percentage of the components contained in existing self-contained directional boring apparatus and thereby eliminates a large percentage of the cost associated with implementing directional boring technology. Due to the lower cost of implementation, the directional boring attachment of the present invention provides many contractors with access to directional boring technology that would otherwise be too expensive for such contractors to afford. Further, by implementing the directional boring apparatus as an attachment, the present invention provides contractors with a mechanism by which they can better utilize equipment such as open trench-type trenching machines that would otherwise go idle.

One feature of the present invention is that it has the capability of providing a new method and apparatus for drilling underground bores, which reduces the capital investment required, when compared to known, self-contoured direction boring equipment.

Additionally, the present invention has the advantage of enabling existing carrier bodies to achieve directional boring capabilities.

The above and other objects, features, and advantages of the present invention will become apparent to those skilled in the art from the following description and the attached drawings.

BRIEF DESCRIPTION OF THE DRAWINGS

FIGS. 4*a* and 4*b* are side views of a carrier-mounted directional boring attachment embodiment of the present invention;

FIG. 5 is a side view of a carrier-mounted embodiment of the present invention;

FIG. 6 is a side view of the ground rest-able embodiment of the present invention, as mounted to an excavator or power shovel;

FIG. 7 is a side view of a ground rest-able directional boring attachment of the present invention using as alternate carrier engagement mechanism different than the one shown in FIG. 6;

FIG. 8 is a side view of the ground rest-able directional boring attachment of FIG. 7, wherein the boom of the power shovel is in a partially retracted position;

FIG. 10 is a side view of a ground rest-able embodiment of the directional boring attachment of the present invention utilizing an alternate coupling mechanism for being coupled to a power shovel;

FIG. 11 is a side view of the ground rest-able embodiment of the directional boring attachment of the present invention mounted to a power shovel, with a coupling mechanism slightly different than that shown in FIG. 10, with the wheel and axle assembly attached to the directional boring attachment;

FIG. 12 is a side view of the ground rest-able embodiment of the directional boring attachment being illustriously coupled to a track-type dozer;

FIG. 13 is a side view of the ground rest-able embodiment of the directional boring attachment of the present invention coupled to a track-type dozer wherein the directional boring attachment has its wheel and axle assembly removed;

FIG. 14 is a side view of a track-type dozer and ground rest-able directional boring device of the present invention, showing an alternate, rear-mounted mounting scheme;

FIGS. 15*a,* 15*b,* and 16 are side views of the ground rest-able embodiment of the directional boring attachment of the present invention, that illustrate various mounting schemes for mounting the boring attachment to a wheel loader with FIGS. 15*a* and 15*b* showing front-mounted mounting schemes; and FIG. 16 illustrating a rear-mounted mounting arrangement.

FIGS. 17 and 18 are side view of the ground rest-able embodiment of the directional boring attachment of the present invention being mounted to a Bobcat® brand skid loader showing alternate mounting configurations, wherein FIG. 17 shows a lift-arm mounted mounting configuration, and FIG. 18 shows a "trailer hitch"-type mounting configuration;

FIG. 18*a* is a side view of another ground rest-able embodiment of the directional boring attachment, wherein the embodiment is shown in a lift arm mounted side positioned embodiment of the directional boring attachment of the present invention coupled to a Bobcat® brand skid loader;

FIGS. 19 and 20 are side views of the ground rest-able embodiment of the directional boring attachment of the present invention, showing various front (FIG. 19) and rear (FIG. 20) mounting arrangements for mounting the boring attachment to a back hoe-type carrier;

FIG. 21 is a side view of the ground rest-able version of the directional boring attachment of the present invention shown as being coupled to an agricultural-type tractor;

FIG. 22 is a side view of the ground rest-able embodiment directional boring attachment of the present invention being coupled to a powered industrial truck or fork lift;

FIG. 23 is a side view of the ground rest-able version of the directional boring attachment of the present invention coupled to a trench-type carrier;

FIGS. 24*a* and 24*b* illustrate side views of the ground rest-able directional boring attachment of the present invention being mounted to the bed of a lift-bed containing on-road vehicle, such as a truck;

FIG. 25 is a side view of the ground rest-able boring attachment of the present invention, being coupled to low grader; and FIG. 26 is a side view of the ground rest-able version of the directional boring attachment being coupled to a roller compactor.

DESCRIPTION OF EXEMPLARY EMBODIMENTS

Figure 1:
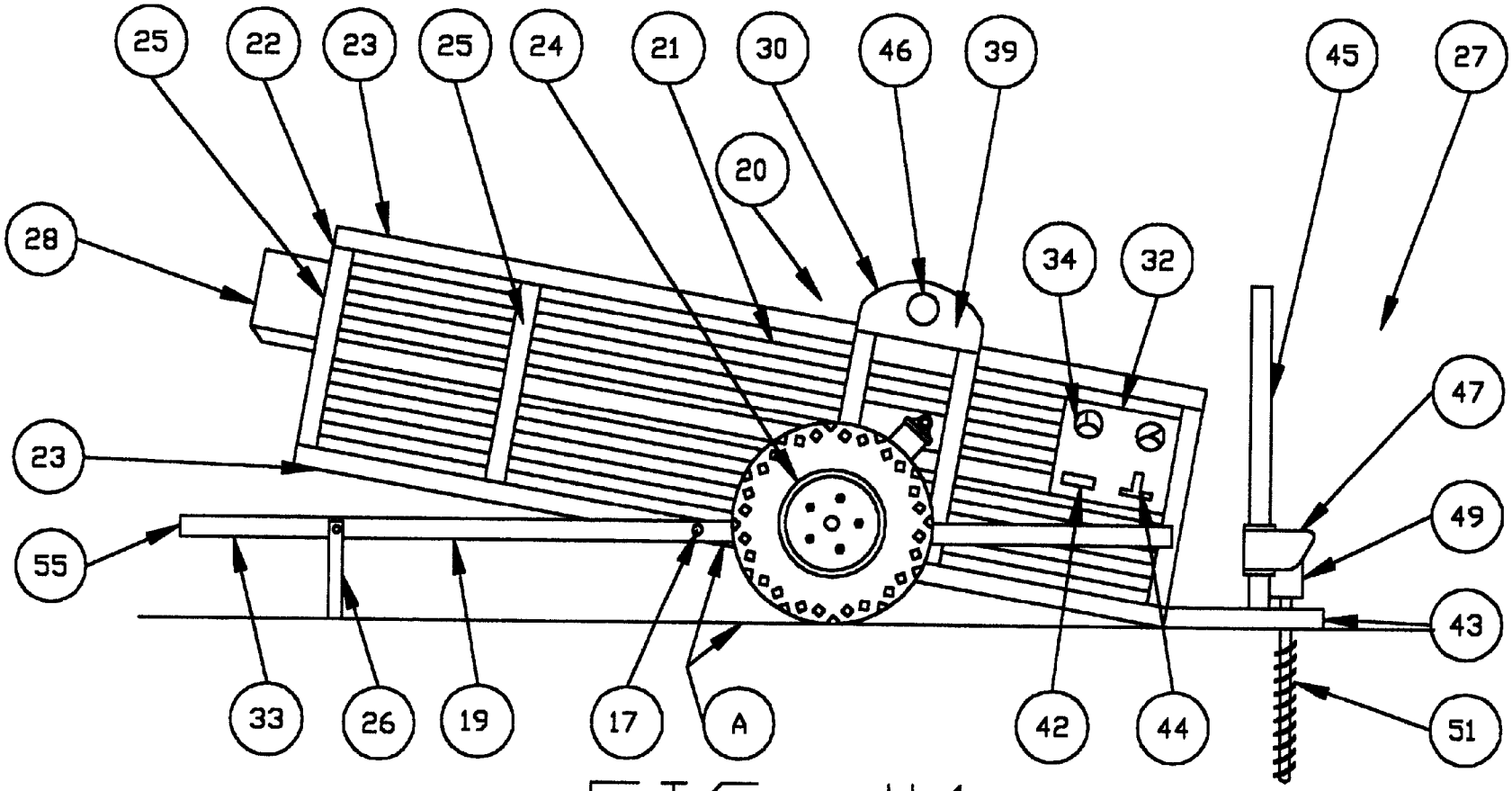
FIG. 1 is a side view of a ground rest-able directional boring attachment that incorporates various features of the present invention.

While the invention is susceptible to various modifications and alternative forms, exemplary embodiments thereof have been shown by way of example in the drawings and will be described in detail herein. However, it should be understood that there is no intent to limit the invention to the particular forms disclosed. Rather, the intention is to cover all modifications, equivalents, and alternatives falling within the spirit and scope of the invention as defined by the appended claims.

Figure 2:
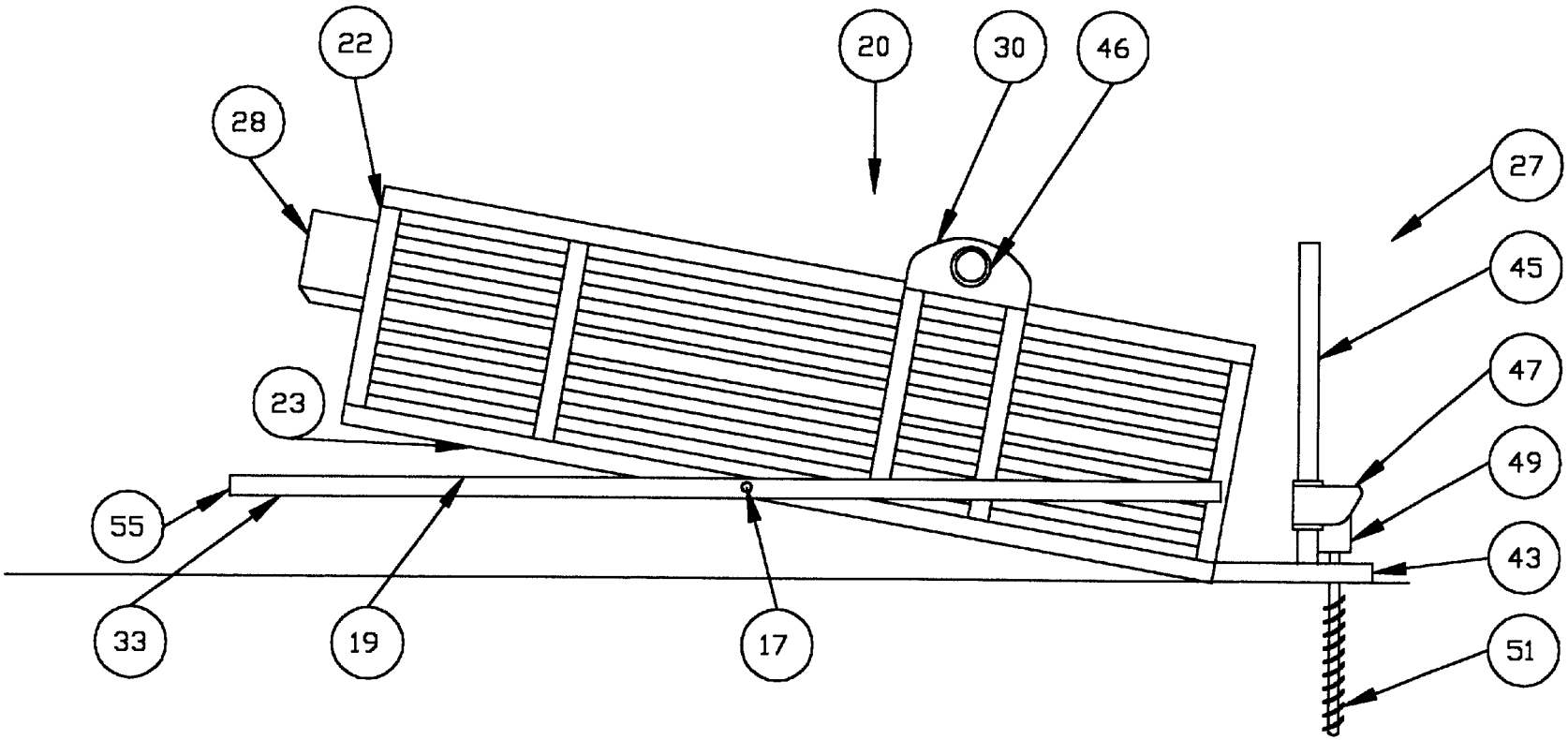
FIG. 2 is a side view of the boring attachment of FIG. 1, absent the axle and wheel assembly of FIG. 1.
Figure 3:
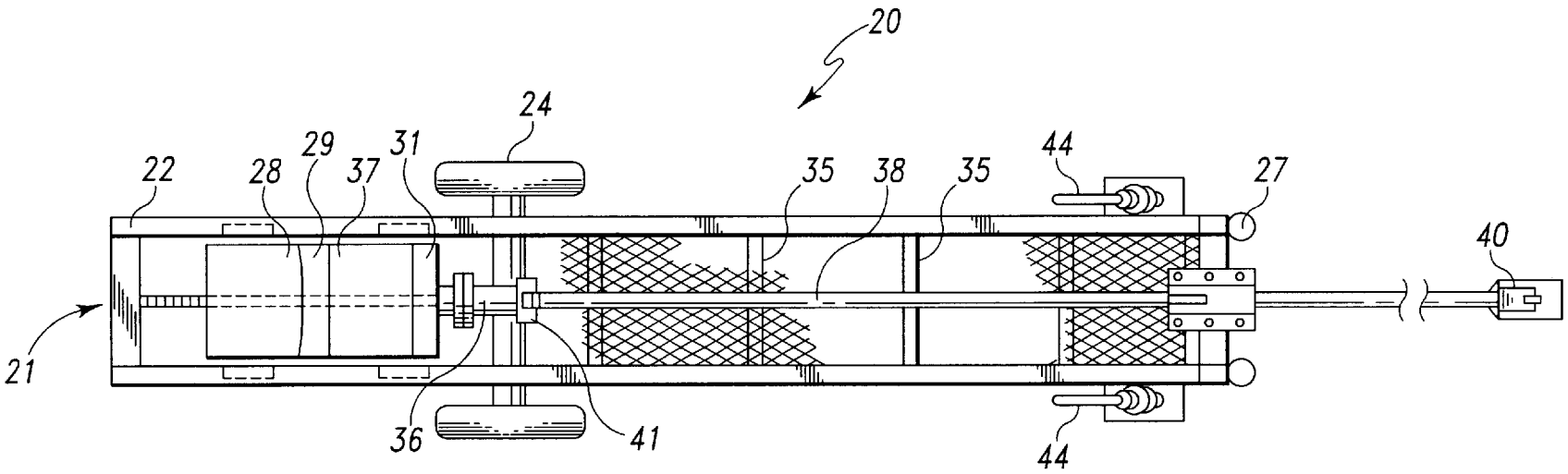
FIG. 3 is a top view of the ground rest-able directional boring attachment embodiment of the present invention.

Referring now to FIGS. 1–3, an exemplary directional boring attachment 20 is illustrated that incorporates various features of the present invention therein. Those of ordinary skill in the art should appreciate that the directional boring attachment 20 is merely exemplary and that the present invention may be advantageously implemented in a wide variety of manners that result in directional boring attachments having components and configurations that differ from those depicted in FIGS. 1–3. For example, the directional boring attachment 20 may be implemented to utilize features of existing directional boring tools such as those described in U.S. Pat. No. 5,944,121 to Bischel et al., U.S. Pat. No. 5,941,320 to Austin et al., U.S. Pat. No. 5,803,189 to Geldner, U.S. Pat. No. 5,778,991 to Runquist et al., and U.S. Pat. No. 4,953,638 to Dunn, the disclosures of which are hereby incorporated by reference.

As depicted in FIGS. 1–3, the directional boring attachment 20 generally includes a directional boring tool 21 and an attachment frame 22 for holding the various components (discussed below) of the directional boring tool. The attachment frame 22 includes a supporting frame 19 for supporting the attachment frame 22. The supporting frame 19 is generally used to attach the directional boring tool 21 to various carrier bodies such as hydraulic excavators, track-type tractors/dozers, standard wheel loaders, articulating wheel loaders, skid loaders, backhoe loaders, agricultural type tractors, powered industrial trucks, forklifts, trenching machines, trucks, road graders, and roller compactors.

The attachment frame 22 in an exemplary embodiment comprises a partially open-sided box-like structure comprised of steel tubes that generally define the elongated cuboidal-rectangular shape and structure of the attachment frame 22. The attachment frame 22 may be further defined or alternatively defined by steel channels, steel beams, and/or equivalent strength materials sized to accommodate the various components of the directional boring tool 21, attachment yoke 30, and attachment mechanisms used to attach the directional boring attachment 20 to a particular carrier body. The attachment frame 22 of the embodiment of FIG. 1 includes both longitudinally extending frame members, (e.g. 23), vertically extending frame members (e.g. 25) and laterally extending frame members (e.g. 35).

When fully assembled, the longitudinally extending 23, vertically extending 25 and laterally extending 35 frame members create an elongated, rectangular cuboidal box-like attachment frame 22 having a hollow interior for holding a plurality of generally cylindrical drill stems 38, along with many other of the boring tools 21 components.

The attachment frame 22 is pivotably coupled at pivot member 17 to a generally horizontally disposed supporting frame 19, that can also be constructed by a rectangular box array of square or rectangular cross-sectioned tubes. The supporting frame 19 is designed to be strong enough to support the weight of the attachment frame 22 when the support frame is serving as a "trailer" for the attachment frame 22 and associated boring/drill equipment tools 21, thereon, and also strong enough to withstand the longitudinal and lateral forces exerted on attachment frame 22 when the boring attachment 20 is performing its horizontal drilling.

The attachment frame 22 generally includes an attachment yoke 30 that includes a pair of upwardly extending reinforced plate members 39 that are attached to the frame members 23, 25, 35 of the attachment frame 22. The plate members 39 each include a large aperture 46 which is aligned with the corresponding aperture of the other plate member 39.

The attachment yolk 30 provides a vehicle through which the device 20 can be moved, such as being lifted. In one embodiment, a large pivot pin member (not shown) can be inserted through the aligned apertures 46, and also through an aperture (not shown) of a carrier body to pivotably connect the attachment yoke 30 (and hence the device 20) to the carrier. Alternately, the pin that extends through the aperture can be engaged to a chain whose other end is attached to a movable carrier member (such as the boom of a power shovel) to permit the boom of the carrier to lift the device 20, otherwise move its geographic position. As another alternative, a chain attached to the carrier body (e.g. power shovel) can be coupled to each of the aligned apertures 46, to permit the boom of the carrier to lift the device 20, or otherwise move its geographic position.

In addition to the large pin (not shown) described above, the attachment yoke 30 can include various other attachment mechanisms 30 such as pins, couplings, hitches, and pivot points that enable the attachment frame 22 and the directional boring attachment device 20 to be attached to the main undercarriage, framework, or other physical attributes of a carrier body.

As depicted, the attachment frame 22 includes an extendable/retractable coupler 33 that is attached to the supporting frame 19. The coupler 33 may be designed to be telescoping, as a tube within a tube; or alternately as an angle on an angle. Further, extendable/retractable coupler 33 can be implemented in a rectangular configuration for directly attaching to the undercarriage of a carrier body, or in a triangular configuration when used as a trailer hitch attachment. Preferably the coupler 33 includes an attachment member, such as a female receiver member of a ball hitch, at its distal end 55 for permitting the coupler 33 to be coupled and de-coupled easily to and from an existing trailer mounting member of the carrier. An example of such a trailer mounting member is a common male hitch ball of the type found on many trucks, SUVs, and other vehicles, or a three point hitch member found on agricultural tractors.

The directional boring tool 21 is carried by the attachment frame 22 which is pivotally coupled to the supporting frame at pivot member 17. The location of the pivot member 17 (and hence the pivot point and pivot axis) depends upon the size of the attachment frame 22 and directional boring tool 21 and whether an existing hydraulic cylinder (see, e.g. cylinder 70 on FIG. 7) of a carrier body is to be mounted toward the front or the rear of the supporting frame 19. As will be illustrated, for example, in FIG. 7 an existing cylinder 70 of a carrier body 60 is generally mounted to the attachment frame 22 in order to provide a mechanism for adjusting the angle of attack of the directional boring tool 21.

As best shown in FIG. 3, the directional boring tool 21 includes a displacement pump 28 and a hydraulic cylinder or hydraulic motor 29. The displacement pump 28 generally drives the hydraulic cylinder 29 which applies an axially directed force to a drill head 36 in a forward and reverse axial direction, which in turn provides an axially directed force to a drill stem 38 coupled thereto. The displacement pump 28 provides varying levels of controlled force when thrusting the drill stem 38 into the ground to create a bore and when retractively extracting the drill stem 38 from the bore during a back reaming operation.

The directional boring tool 21 also includes a rotation pump 30 and a rotation motor 31. The rotation pump 37 generally drives the rotation motor 31 which provides va g levels of controlled rotation to the drill stem 38 and the drill bit 40 as the drill stem 38 and drill bit 40 are thrust axially forwardly into a bore when operating the directional boring tool 21 in a drilling mode of operation, and for rotating the drill stem 38 and the drill bit 40 when extracting the drill stem 38 and drill bit 40 axially backwardly through the bore when operating the directional boring tool 21 in a back reaming mode. The directional boring tool 21 also includes a coupling drive 41 for advancing and threading individual drill stems 38 together.

The directional boring tool 21 further includes a control panel or control interface, such as a control panel 32, that includes a number of manually actuatable switches e.g. 42, knobs, and levers, e.g. 44, for manually controlling the displacement pump 28, rotation motor 31, motors, and other components that are incorporated as part of the directional boring attachment 20. The control panel 32 also includes a display including display elements such as gauges 34, LED's, LCD screens, etc. on which various configuration and operating parameters are displayable to an operator of the directional boring apparatus 20.

A wheel assembly 24 can also mounted to the attachment fame 22, and in particular the supporting frame 19 in order to provide a mechanism for facilitating the transport of the directional boring attachment 20. In an exemplary embodiment, the wheel assembly 24 is pivotly mounted to the supporting frame 19 in order to allow the wheel assembly 24 to be retracted upwardly and extended downwardly, in a direction indicated generally by arrow A, as needed by a hydraulic cylinder retraction mechanism (not shown). For example, in cases where the weight carrying capacity of a carrier body is limited, the wheel assembly 24 may be extended downward and locked into its ground-engaging position to bear a significant percentage of the device's 20 weight, thereby relieving the carrier body of total vertical support and weight and force bearing responsibilities. In an exemplary embodiment, the wheel assembly 24 is placed just forwardly of the center of gravity toward the front 27 of the directional boring tool 20 to support the directional boring attachment 20 relatively nearer to the front 27 of the supporting frame 19. However, the physical parameters and location of wheel assembly 24 are dependent upon the size, weight, length, and supported angles of attack of the directional boring device 20

As best shown in FIG. 2, the wheel assembly 24 (FIG. 1) can be designed to be removable. As will be shown in reference to other figures below, certain circumstances exist when the attachment of the wheel assembly 24 to the supporting frame 19 is valuable, but others exist (such as when the device 20 is used in connection with a Bobcat® brand skid loader-type carrier shown in FIGS. 18*b* and 18*c*) where the device performs better if placed directly on the ground, with the wheel assembly 24 removed, or fully retracted to a position where the bottom surface of the tires is above the lower, ground-engaging surface of the supporting frame 19.

A first stabilizer assembly 26 (FIG. 1) is mounted toward the rear of the attachment frame 22. The illustrated first stabilizer assembly 26 includes a pair of spaced, adjustable support legs that are locked into a ground-engaging vertical position after positioning the directional boring attachment 20 at a desired drilling site. The first stabilizer assembly 26 helps to stabilize the directional boring attachment 20 during a drilling and reaming operation.

A second stabilizer assembly 27 (FIGS. 1 and 3) in an exemplary embodiment is mounted toward the front of the rear (distal) end 55 of the supporting frame 19. The second stabilizer assembly 27 in the exemplary embodiment includes a ground engaging, horizontally disposed plate 43 to which a vertically extending guide pole 45 is attached. The guide pole 45 is generally cylindrical for receiving a vertically extending aperture of a collar 47 which is vertically movable along the guide pole. A rotationally driveable stake driver 49, is configured for rotatably driving an auger-type stake 51 into and out of engagement with the ground The engagement of the stake 51 with the ground helps to fixedly position the device 20, to keep it from moving backwardly or forewardly in response to the axial faces exerted by the drill stem 38 and drill bit 40 as they move, respectively, axially forwardly to drill a bore, and axially backwardly during the reaming of the bore hole.

Referring now to FIGS. 4–11, several examples of coupling mechanisms are illustrated for coupling the direction boring attachment 20 to an excavator 60. It is important to note that the directional boring attachment embodiment 54 employs an attachment frame wherein the ground engaging supporting frame, (e.g. 19) is replaced with a carrier mountable supporting frame 56, which is best shown in FIG. 5. In general, the directional boring attachment 20 in FIGS. 4–11 is powered, operated and moved by the excavator 60. In an exemplary embodiment, the directional boring attachment 54 is powered by the hydraulic system of the excavator 60. Depending upon the requirements of the directional boring attachment 54 and the capacity of the hydraulic system of the excavator 60, the hydraulic system may need to be upgraded with larger hydraulic pumps, additional hydraulic pumps, and/or regulated to operate the existing equipment of the excavator 60 and the attached directional boring attachment 54. As is typical of most excavators, the hydraulic lines of the excavator 60 include installed tees, valves, quick couplers, and additional lengths of hydraulic lines that facilitate coupling the hydraulic system of the excavator 60 to the hydraulically driven pumps, motors, and/or cylinders of the directional boring attachment 54.

Besides being powered by the hydraulic system of the excavator 60, the directional boring attachment 54 may alternately be powered by either a power take-off (P.T.O.) of the excavator 60 or be engine shaft driven and located underneath, behind, or in front of the excavator 60. The directional boring attachment 54 may also be powered by batteries, generators, and/or alternators of the existing electrical system of the excavator 60. Depending upon the requirements of the directional boring attachment 54 and the capacity of the existing electrical system, one may need to upgrade the electrical system of the excavator 60 with larger batteries, additional batteries, additional alternators, larger alternators, and/or regulated to operate existing equipment of the excavator 60 and the directional boring attachment 54.

In an exemplary embodiment, the directional boring tool 21 and the other controllable features of the directional boring attachment 54 are operated by the control panel similar to control panel 32 that can be mounted inside the existing cab of the excavator 60 and operatively coupled to the directional boring attachment 54 via a wired and/or wireless communications link. Alternatively, the control panel 32 may be mounted upon the directional boring attachment 54 or incorporated into a portable remote unit that is operatively coupled to the directional boring attachment 54 via a wired and/or wireless communications link.

Figure 4A:
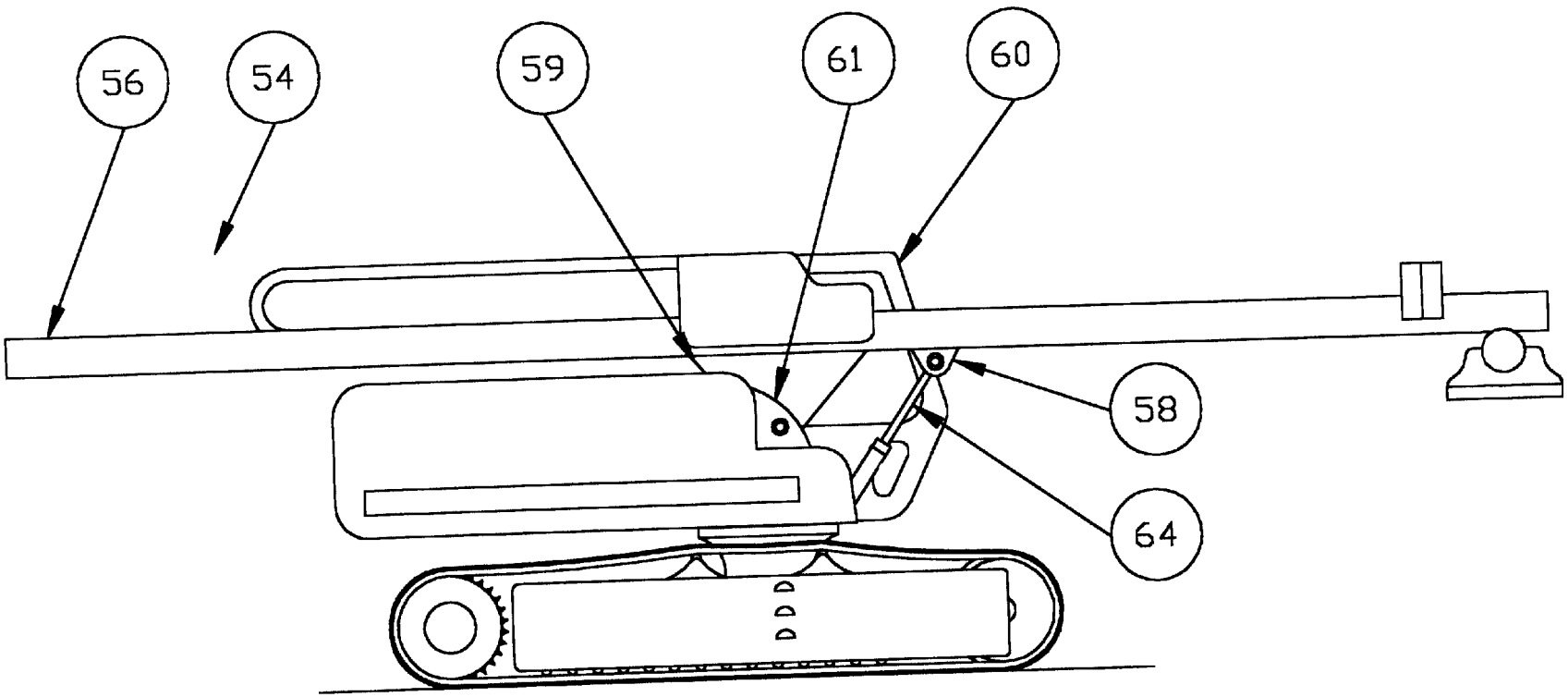
Figure 5A:
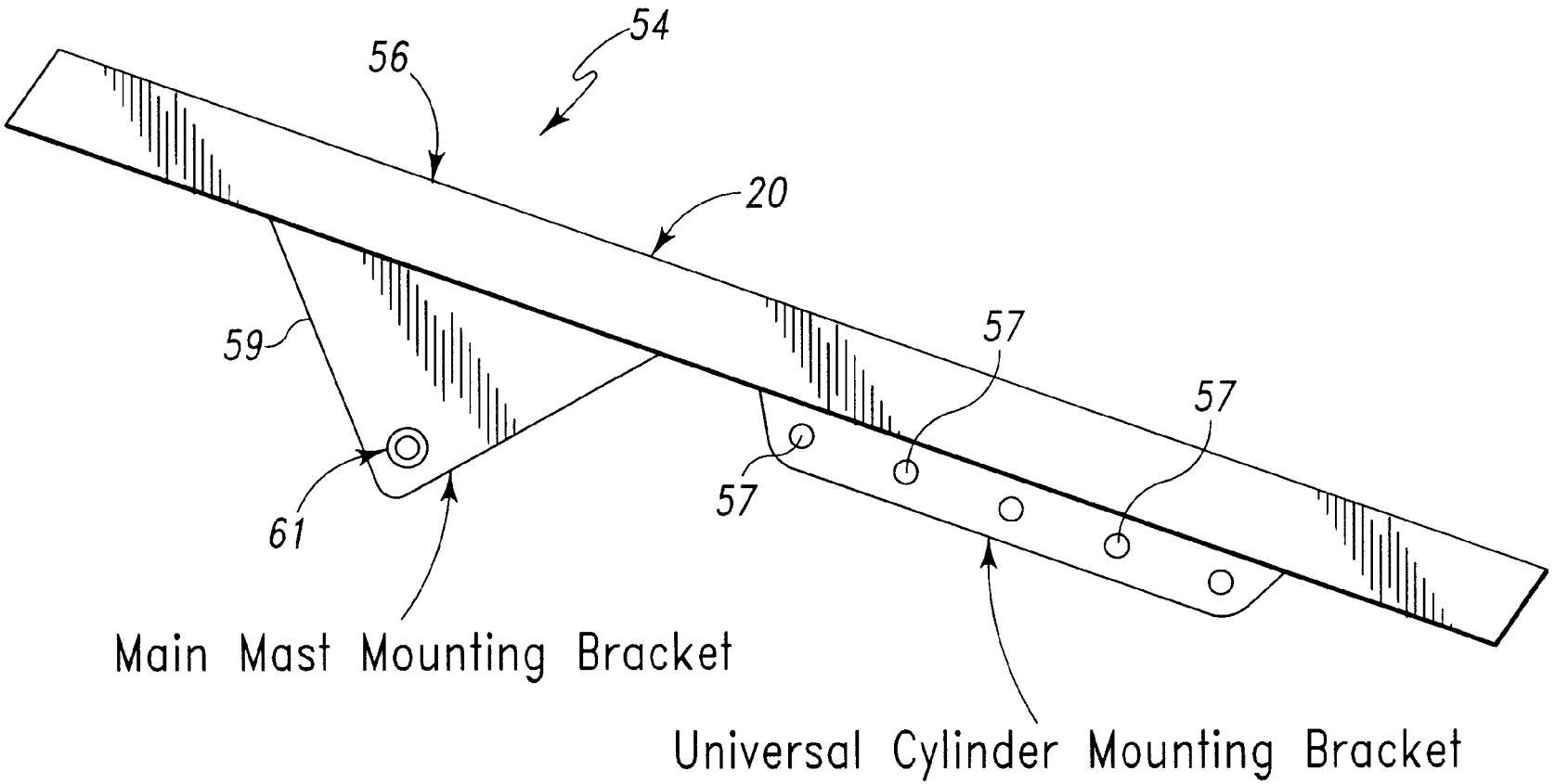
FIG. 5*a* is a side view of a carrier-mounted supporting frame of the directional boring attachment of the present invention.
Figure 9:
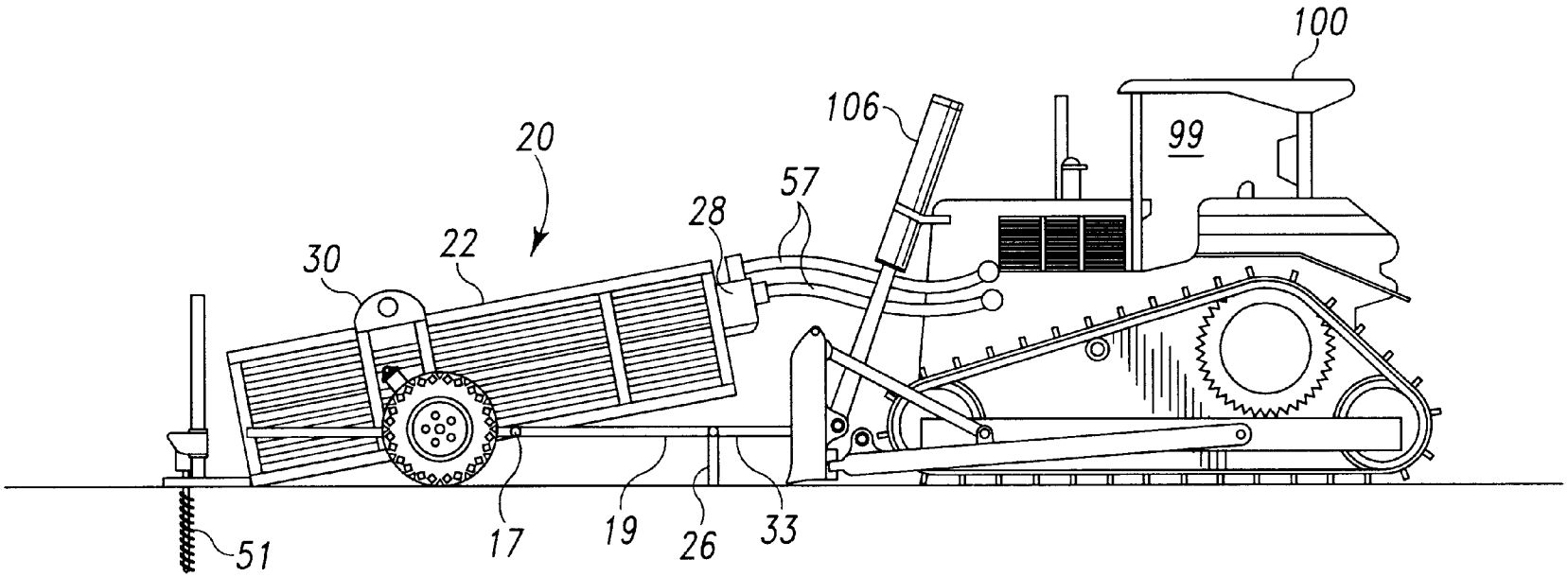
FIG. 9 is a side view of a ground rest-able embodiment of the present invention, shown being mounted to a bull dozer-type carrier.

Examples of a directional boring attachment 20 attached to an excavator 60 are shown in FIGS. 4, 4*a* and 5. In these embodiments, the entire boom assembly 62 of the excavator 60 is unpinned and removed prior to installation of the boring attachment 54. The attachment frame 56 of the directional boring attachment 54 is then installed and pivotably coupled into place at a pivot point 61, so that the boring attachment is placed in the same place where the boom assembly was removed from the excavator's 60 main body frame. As best shown in FIG. 5*a,* pivot point 51 comprises a laterally extending aperture 61 formed to extend through a vertically disposed main mast mounting bracket 59 that is formed as a part of, and extends downwardly from, the attachment frame 56.

As excavators generally do not have standardized parts, the attachment frame 56 of the directional boring attachment 54 will likely need to be custom fitted to each type of excavator that the directional boring attachment is to be coupled to in this manner. More specifically, the dimensional parameters of the attachment frame 56 such as pin placement and pin size depend upon (1) the excavator's dimensions, (2) the size, dimensions, and weight of the directional boring attachment 54, (3) clearance requirements of the excavator 60 and the directional boring tool 21, and (4) the angles of attack supported by the directional boring tool 21.

Instead of being pivotably coupled to the pivot point 61 of the excavator 60, the attachment frame 56 may be bolted and/or welded to the carrier frame of the excavator 60. In an exemplary embodiment, the boom engaging hydraulic cylinders 64 are pivotably pinned to one of the series of apertures 57 of a vertically disposed mounting bracket 58 that is formed as a part of the attachment frame 56 in order to provide a mechanism for controlling the angle of attack for the directional boring tool 21.

It should also be noted that the excavator 60 shown in FIG. 5 uses an auger-type 51 ground engaging system, similar to the device 20 shown in FIG. 1. However, the excavation 60 shown in FIGS. 4*a* and 4*b* employs a ground engaging weighed foot 63 for engaging the front end 43 of the directional boring attachment device 54 to the ground.

Additional examples of attaching the directional boring attachment 20 to an excavator 60 are illustrated in FIGS. 6–7. In FIGS. 6 and 7, a ground rest-able directional boring attachment 20, that is generally similar to the attachment 20 shown in FIGS. 1–3, is mounted to the distal end 62 of the boom 66 of the excavator 60. In the device of FIGS. 6–7, the bucket (not shown) that is normally attached to the distal end 62 of the boom 66 of the excavator 60 is unpinned (decoupled) and removed. A vertically extending, aperture containing mounting bracket 65 is formed as a part of the attachment frame. The mounting bracket 65 of the attachment frame 22 of the directional boring attachment 20 is then installed and pivotably pinned into place at a pivot point 68 where the bucket (not shown) was removed. As stated above, excavators generally do not have standardized parts. Accordingly, the attachment frame 22 of the directional boring attachment 20 likely needs to be custom fitted and/or fabricated to each type of excavator that the directional boring attachment 20 is to be coupled to in this manner. Again, instead of being pinned to the pivot point 68 of the excavator 60, the frame 22 may be bolted and/or welded to the pivot point 68.

In an exemplary embodiment, the hydraulic cylinders 70 of the boom 66 are pivotably pinned to either the rear mounting bracket 65 (FIG. 6) or the attachment yoke bracket 30 (FIG. 7) of the attachment frame 22 in order to provide a mechanism by which to control the angle of attack for the directional boring tool 21. The specific size of mounting brackets, sleeves, and locations will vary according to the size of the excavator, the size of the direction boring attachment, and the angle of attack required for the direction boring attachment 20. Furthermore, the first stabilizer assembly 26 is locked into its ground engaging position to provide further support for the directional boring attachment 20 during operation.

A further example of attaching the direction boring attachment to the excavator 60 is illustrated in FIG. 8. As illustrated, the directional boring attachment 20 is attached to the excavator's undercarriage framework by the extendable/retractable coupler 33 which may include pins, couplings, and other attachment mechanisms. The bucket (not shown) of the jointed boom assembly 66 is removed from the distal arm 67, the boom 66 thus creating a pivot point 76 to which the attachment yoke 30 of the direction boring attachment 20 may be pivotably attached.

In an exemplary embodiment, the distal hydraulic cylinders 70 of distal arm 67 is pivotably coupled to the attachment frame 22 in order to provide a mechanism for controlling the angle of attack of the directional boring tool 21. Again, the specific size of attachment plates, sleeves, and locations will vary according to the size of the excavator 60, the size of the direction boring attachment, and the angles of attack supported by the directional boring tool 21. Further, as depicted in FIG. 8, the first stabilizer assembly 26 may be locked into its ground engaging position to provide further support for the directional boring attachment 20 during operation.

FIGS. 10 and 11 illustrate yet further examples of attaching the directional boring attachment 20 to an excavator 60. As depicted in FIGS. 10 and 11, the rear end 55 of the supporting frame 19 of the attachment frame 22 is attached to the excavator's main undercarriage by the extendable/retractable coupler 33. The bucket 74 that is pivotably coupled to the distal end of the distal arm 67 is left in place on the boom 66 and used to lift the directional boring attachment 20 via a chain-type sling 69 coupled between a hook (or eye) 71 on the back (non-working) surface of the bucket 74 and an aperture 46 of the attachment yoke 30 of the attachment frame 22. Further, the bucket 74 may be positioned such that the bucket 74 rests on the attachment yoke 30 of attachment frame 22 for additional weight and stability during the operation of the directional boring tool 21.

In an exemplary embodiment, one or more existing hydraulic cylinders (not shown) that are disposed under the excavator 60 are pivotably coupled to the attachment fame 22 in order to provide a mechanism for controlling the angle of attack of the directional boring tool 21. Again, the specific size of attachment plates, sleeves, and locations will vary according to the size of the excavator 60, the size of the direction boring attachment, and the angles of attack supported by the directional boring tool 21. Furthermore, as depicted in FIG. 11, the first stabilizer assembly 26 may be locked into place and the wheel assembly 24 lowered to provide further support for the directional boring attachment 20 during operation. Note also that FIG. 11 illustrates a two chain 69, 73 sling arrangement, rather than the single chain 69 arrangement shown in FIG. 10. Referring now to FIGS. 10 and 11, it should be noted that FIG. 10 depicts the auger in its raised, or ground-disengaged portion, whereas FIG. 11 depicts the auger 51 in its lowered, ground-engaging and penetrating position.

FIGS. 9 and 12–14 illustrate several examples of coupling the exemplary ground rest-able direction boring attachment 20 to a track type tractor/dozer carrier body 100. In general, the directional boring attachment 20 in FIGS. 9 and 12–14 is powered, operated and moved by the tractor/dozer 100. In an exemplary embodiment, the directional boring attachment 20 is powered by the hydraulic system of the tractor/dozer 100. Depending upon the requirements of the directional boring attachment 20 and the capacity of the hydraulic system of the tractor/dozer 100, the hydraulic system may need to be upgraded with larger hydraulic pumps, additional hydraulic pumps, and/or regulated to operate the existing equipment of the tractor/dozer 100 and the attached directional boring attachment 20. As is typical of most tractor/dozers, the hydraulic lines of the tractor/dozer 100, power (hydraulic) fluid coupling devices, fluid lines and fluid control devices such as installed tees, valves, quick couplers, and additional lengths of hydraulic lines 57 that facilitate coupling the hydraulic system of the tractor/dozer 100 to the hydraulically driven pumps, motors, and/or cylinders (e.g. the displacement pump 28) of the direction boring attachment 20.

Besides being powered by the hydraulic system of the tractor/dozer 100, the directional boring attachment 20 may alternatively be powered by a power take-off (P.T.O.) of the tractor/dozer 100 and/or engine shaft located underneath, behind, or in front of the tractor/dozer 100. The directional boring attachment 20 may also be powered by batteries, generators, and/or alternators of the existing electrical system of the tractor/dozer 100. Depending upon the requirements of the directional boring attachment 20 and the capacity of the existing electrical system of the tractor/dozer 100 the electrical system may need to be upgraded with larger batteries, additional batteries, additional alternators, larger alternators, and/or regulated to operate existing equipment of the tractor/dozer 100 and directional boring attachment 20.

In an exemplary embodiment, the directional boring tool 21 and the other controllable components of the directional boring attachment 20 are operated by the control panel (see control panel 32 of FIG. 1) that can be mounted in the existing cab 99 (such as on the dashboard) of the tractor/dozer 100 and operatively coupled to the directional boring attachment 20 via a wired and/or wireless communications link. Alternately, the control panel 32 may be mounted upon the directional boring attachment 20 (such as shown in FIG. 1) or incorporated into a portable remote unit that is operatively coupled to the directional boring attachment 20 via a wired and/or wireless communications link.

In the embodiment shown in FIGS. 12 and 13, the tractor loader bucket or the dozer blade (see 102 at FIG. 14) of the tracker/dozer 100 is unpinned and removed at a pivot point 104. The directional boring attachment 20 is pivotably attached, by a pivot pin at pivot point 104 to the extendable/retractable coupler 33 which may include pins, couplings, ball-hitches and other attachment mechanisms. As tracker/dozers generally do not have standardized parts, the attachment frame 22 of the directional boring attachment 20 may need custom fabrication or fitting for different types of tracker/dozer that the directional boring attachment 20 is to be coupled to in this manner. More specifically, the dimensional parameters of the attachment frame 22, such as pin placement and pin size, depend upon: (1) the tracker/dozer's dimensions; (2) the size, dimensions; and weight of the directional boring tool 21; (3) clearance requirements of the tracker/dozer 100 and the directional boring tool 21; and (4) the angles of attach supported by the directional boring tool 21.

Instead of being pivotably coupled by a pivot pin arrangement to the tracker/dozer 100, the attachment frame 22 may be bolted and/or welded to the pivot point 104. In the exemplary embodiment shown in FIGS. 9 and 13, the hydraulic cylinders 106 that are normally used for moving the bucket/or blade 102 are pivotably coupled to the attachment frame 22 in order to provide a mechanism by which to control the angle of attack for the directional boring tool 21. Furthermore, as depicted in FIG. 12, the first stabilizer assembly 26 may be locked into its ground-engaging position and the wheel assembly 24 extended downward to provide further support for the directional boring attachment 20 during operation, thus relieving the tracker/dozer 100 of supporting the entire weight and lateral stresses of the device 20.

FIG. 14 illustrates another example of attaching the directional boring attachment 20 to a track-type tractor/dozer 100. As illustrated, the back end-placed coupler 33 of the attachment frame 22 is attached to the rear end of the dozer 100 by attachment to the main undercarriage of the tractor/dozer 100.

In an exemplary embodiment, existing hydraulic or pneumatic cylinders (not shown) under the tractor/dozer 100 are pivotably coupled to the attachment frame 22 in order to provide a mechanism by which to control the angle of attack of the directional boring tool 21, by permitting the attachment frame 22 to pivot relative to the supporting frame 19 about the pivot axis formed by pivot 17. Again, the specific size of attachment plates, sleeves, and locations will vary according to the size and design of the tractor/dozer 100, the size of the direction boring attachment, and the angles of attack supported by the directional boring tool 21. Furthermore, as depicted in FIG. 14, the first stabilizer assembly 26 may be locked into its ground-engaging position, and the wheel assembly 24 lowered to provide further support for the directional boring attachment 20 during operation.

FIGS. 15*a,* 15*b* and 16 illustrate embodiments wherein the direction boring attachment 20 is coupled to a standard or articulating wheel loader 150. In general, the directional boring attachment 20 in FIGS. 15*a,* 15*b* and 16 is powered, operated and moved by the wheel loader 150. In an exemplary embodiment, the directional boring attachment 20 is powered by the hydraulic system of the wheel loader 150. Depending upon the requirements of the directional boring attachment 20 and the capacity of the hydraulic system of the wheel loader 150 of the wheel loader 150, the hydraulic system may need to be upgraded with larger hydraulic pumps, additional hydraulic pumps, and/or regulated to operate the existing equipment of the wheel loader 150 and the attached directional boring attachment 20. As is typical, the hydraulic lines of the wheel loader 150 include hydraulic system components for conveying power (hydraulic) fluid, for controlling the flow of fluid, and for connecting various components together, such as installed tees, valves, quick couplers, and additional lengths of hydraulic lines that facilitate coupling the hydraulic system of the wheel loader 150 to the hydraulic system of the directional boring attachment 20.

Besides being powered by the hydraulic system of the wheel loader 150, the directional boring attachment 20 may alternatively be powered by a power take-off (P.T.O.) of the wheel loader 150 and/or engine shaft located underneath, behind, or in front of the wheel loader 150. The directional boring attachment 20 may also be powered by batteries, generators, and/or alternators of the existing electrical system of the wheel loader 150 and regulated as needed. Depending upon the requirements of the directional boring attachment 20 and the capacity of the existing electrical system of the wheel loader 150, the electrical system may need to be upgraded with larger batteries, additional batteries, additional alternators, larger alternators, and/or regulated to operate existing equipment of the wheel loader 150 and directional boring attachment 20.

In an exemplary embodiment, the directional boring tool 21 and the other controllable components of the directional boring attachment 20 are operated by a control panel, such as control panel 32 (FIG. 1) that is mounted within the existing cab 152 of the wheel loader 150 and operatively coupled to the directional boring attachment 20 via a wired and/or wireless communications link. Alternatively, the control panel 32 may be mounted upon the directional boring attachment 20 in a manner similar to that shown in FIG. 1, or incorporated into a portable remote unit, any of which are operatively coupled to the directional boring attachment 20 via a wired and/or wireless communications link.

As illustrated by the example of FIG. 15*b,* the bucket or blade 152 (FIG. 15*a*) of the wheel loader 150 is de-coupled by unpinning, and removed at a pivot point 154 prior to the attachment of the directional boring device 20. The directional boring attachment 20 is attached to the pivot point 154 by the extendable/retractable coupler 33. As wheel loaders generally do not have standardized parts, the attachment frame 22 of the directional boring attachment 20 may need custom fitting or fabrication for each type of wheel loader that the directional boring attachment 20 is to be coupled to in this manner. More specifically, the dimensional parameters of the attachment frame 22 such as pin placement and pin size depend upon: (1) the dimensions of the wheel loader 150; (2) the size, dimensions, and weight of the directional boring tool 21; (3) clearance requirements of the wheel loader 150 and the directional boring tool 21; and (4) the angles of attack supported by the directional boring tool 21.

FIG. 15*a* illustrates a somewhat modified coupling scheme wherein the front end bucket 152 is allowed to remain attached to the loader. The coupler 33 is then coupled to a coupling member, such as a yoke, eye, ball hitch, etc. that is placed on or in the interior of the bucket 152 by the existing bucket 152 mount system of the loader 150 can effect appropriate movement of the boring device 20. Such movement can either be geographic, to move it along the ground into its desired geographic position, or pivotal movement of the device to establish or change the angle of attachment of the drill tool 21.

Returning back to FIG. 15*b,* it will be noted that a linkage mechanism is pivotably coupled to extend between a rear mounted mounting bracket 155 that is fixedly coupled to the attachment frame 22 of the boring device 20, and a hydraulic cylinder attachment point 153 of the loader 150. The hydraulic cylinders 156 of the bucket/or blade 152 of the dozer are operatively coupled to the attachment frame 22 in order to provide a mechanism for permitting the hydraulic cylinders 156 of the loader 150 to control the angle of attack for the directional boring tool 21. Furthermore, as depicted in FIG. 15, the first stabilizer assembly 26 may be locked into its ground engaging position and the wheel assembly 24 extended downward and locked into its ground-engaging position to provide further support for the directional boring attachment 20 during operation, thus relieving the wheel loader 150 of total weight and stress support responsibilities.

FIG. 16 illustrates another example of attaching the directional boring attachment 20 to a wheel loader 150. As illustrated, the back end of the supporting arm 19 is attached to a hitch member 157 of the main undercarriage of the wheel loader 150 by the extendable/retractable coupler 33, in much the same way that a boat trailer is attached to a pick-up truck In an exemplary embodiment, existing hydraulic cylinders (not shown) under the wheel loader 150 are pivotably coupled to the attachment frame 22, such as via a connection to a rear-mounted mounting bracket (not shown) in order to provide a mechanism for controlling the angle of attack of the directional boring tool 21. Again, the specific size of attachment plates, sleeves, and locations will vary according to the size and configuration of the wheel loader 150, the size of the direction boring attachment, and the angles of attack supported by the directional boring tool 21. Furthermore, as depicted in FIG. 16, the first stabilizer assembly 26 may be locked into its ground-engaging position and the wheel assembly 24 lowered to provide further support for the directional boring attachment 20 during operation.

Figure 18Q:
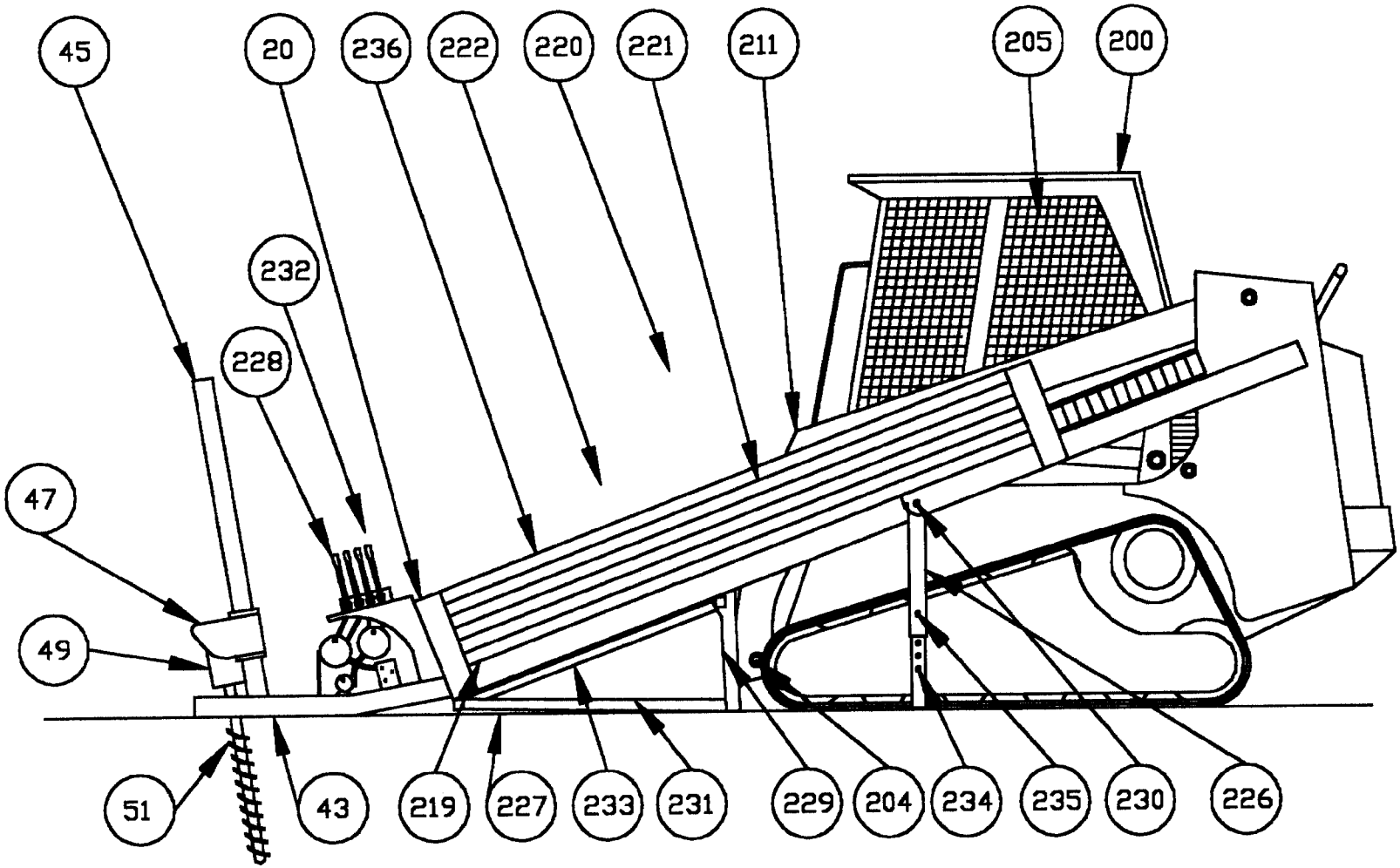
Figure 18B:
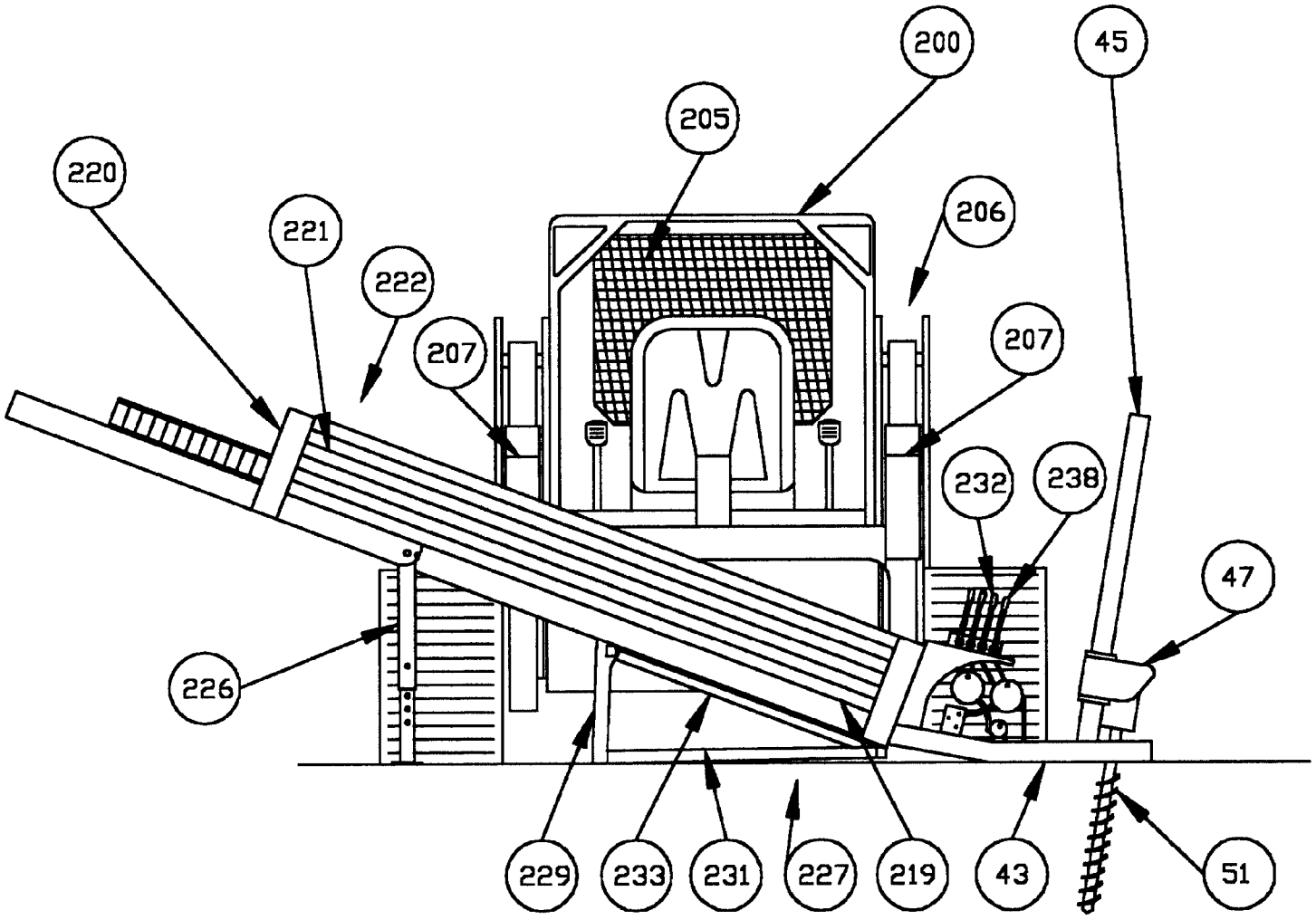
FIG. 18*b* is a front view of the ground rest-able embodiment of FIG. 18*a,* illustrating a front, transversely positioned, ground rest-able mounting arrangement therefor.
Figure 18C:
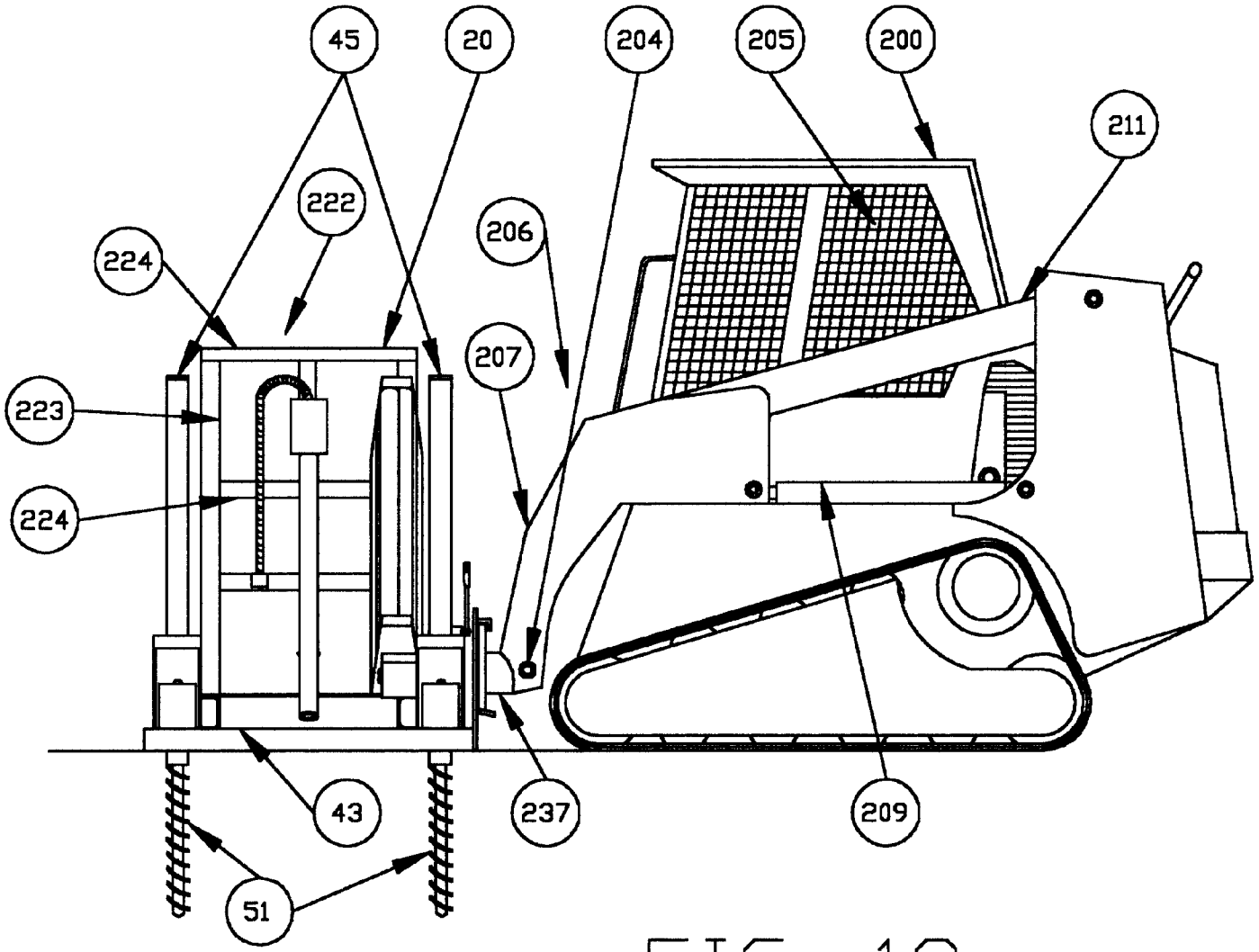
FIG. 18*c* is a side view of the embodiment shown in FIG. 18*b*.

FIGS. 17–18*c* illustrate examples of coupling the exemplary direction boring attachment 20 to a skid loader 200. The directional boring attachments 20, 220 in FIGS. 17–18*c* are primarily powered, operated and moved by the skid loader 200. In the exemplary embodiments, the directional boring attachments 20, 220 are powered by the hydraulic system of the skid loader 200. Depending upon the requirements of the directional boring attachments 20, 220 and the capacity of the hydraulic system of the skid loader 200, the hydraulic system may need to be upgraded with larger hydraulic pumps, additional hydraulic pumps, and/or regulated to operate the existing equipment of the skid loader 200 and the attached directional boring attachments 20 (FIGS. 17 and 18), 220 (FIGS. 18*a*–18*c*). As is typical of most skid loaders, the hydraulic lines of the skid loader 200, include installed tees, valves, quick couplers, and additional lengths of hydraulic lines that facilitate coupling the hydraulic system of the skid loader 200 to the directional boring attachments 20, 220.

Besides being powered by the hydraulic system of the skid loader 200, the directional boring attachments 20, 220 may alternatively be powered by a power take-off (P.T.O.) of the skid loader 200 and/or engine shaft located underneath, behind, or in front of the skid loader 200. The directional boring attachments 20, 220 may also be powered by batteries, generators, and/or alternators of the existing electrical system of the skid loader 200 and regulated as needed. Depending upon the requirements of the directional boring attachments 20, 220 and the capacity of the existing electrical system of the skid loader 200, the electrical system may need to be upgraded with larger batteries, additional batteries, additional alternators, larger alternators, and/or regulated to operate existing equipment of the skid loader 200 and directional boring attachments 20, 220.

In an exemplary embodiment, the skid loader includes a partially enclosed cab 205 and a lift arm assembly 206 for lifting and controlling the operation of an attachment such as a bucket 202 (FIG. 18) for excavating and lifting dirt. The lift arm assembly 206 includes a lift arm 207, a link arm 211 pivotably coupled to each of the lift arm 207 and the skid loader housing 213, and/or the skid loader's internal components and/or frame (not shown); and also a hydraulically or pneumatically activated cylinder 209 that is pivotably coupled to each of the lift arm 207 and housing 211, and is provided for moving the lift arm 207 and otherwise controlling its operation.

In an exemplary embodiment, the directional boring tool 21 and the other controllable components of the directional boring attachments 20, 220 are operated by a control panel (similar to control panel 32 in FIG. 1) that is mounted at the existing cab of the skid loader 200 and operatively coupled to the directional boring attachments 20, 220 via a wired and/or wireless communications link. Alternatively, as shown in FIG. 18*a,* control panel 232 may be mounted upon the directional boring attachment 220 or incorporated into a portable remote unit that are operatively coupled to the directional boring attachments 20, 220 via a wired and/or wireless communications link.

As illustrated by the example of FIG. 17, the bucket or blade 202 of the skid loader 200 is unpinned and removed at a pivot point 204. The directional boring attachment 20 (which is generally similar to the boring attachment 20 of FIG. 1) is pivotably attached to the pivot point 204 by the extendable/retractable coupler 33. As all skid loaders generally do not have the same standardized parts, the attachment frame 22 of the directional boring attachment 20 may need custom fitting and/or fabrication for each type of skid loader that the directional boring attachment 20 is to be coupled to in this manner. More specifically, the dimensional and design parameters of the attachment frame 22 such as pin placement and pin size depend upon: (1) the dimensions of the skid loader 200; (2) the size, dimensions, and weight of the directional boring tool 21; (3) clearance requirements of the skid loader 200 and the directional boring tool 21; and (4) the angles of attack supported by the directional boring tool 21.

Instead of being pivotably coupled by a pivot pin to the pivot point 204 of the skid loader 200, the attachment frame 22 and/or supporting frame 19 may be bolted and/or welded to the pivot point 204. In the embodiment of FIG. 17, the hydraulic cylinders (not shown) for the bucket/or blade 202 move the attachment frame 22 by virtue of the connection of lift arm 207 to supporting frame 19 in order to provide a mechanism by which to control the angle of attack for the directional boring tool 21. In the embodiment of FIGS. 17 and 18, the supporting frame 19 and attachment frame 22 can be fixedly coupled together to move together, as opposed to being movable with respect to each other to change the drill tool attack angle, as in the description of FIG. 1. Alternately, a separate moving member, such as a separately operable hydraulic cylinder (not shown) can be coupled between the skid loader 200 and a mounting bracket, such as attachment yoke 30, for making the attachment frame 22 movable with respect to the supporting frame 19 about pivot member (and pivot axis) 17. Furthermore, the first stabilizer assembly 26 may be locked into place, such as is shown in FIG. 1, and the wheel assembly 24 extended downward (also shown in FIG. 1) to provide further support for the directional boring attachment 20 during operation, thus relieving the skid loader 200 of total support and stress responsibilities for the device.

FIG. 18 illustrates another example of attaching the directional boring attachment 20 to a skid loader 200. As illustrated, the back end of the attachment frame 22 is attached to the main undercarriage of the skid loader 200 by the extendable/retractable coupler 33 at the rear of the skid loader. In an exemplary embodiment, existing hydraulic cylinders (not shown) under the skid loader 200 are pivotably coupled to the attachment frame 22 in order to provide a mechanism by which to control and change the angle of attack of the directional boring tool 21. Again, the specific size of attachment plates, sleeves, and locations will vary according to the size of the skid loader 200, the size of the direction boring attachment, and the angles of attack supported by the directional boring tool 21. Furthermore, as depicted, the first stabilizer assembly 26 may be locked into its ground-engaging and the wheel assembly 24 lowered to provide further support for the directional boring attachment 20 during operation.

Turning now to FIGS. 18*a,* 18*b* and 18*c,* another embodiment 220 of the directional boring attachment is shown. Directional boring attachment 220 is, in most respects, similar to boring attachment 20, shown in FIG. 1. However, the primary difference between the two different embodiments is that the directional boring attachment 220 of FIGS. 18*a,* 18*b* and 18*c* does not include a separate supporting frame (e.g. 19) that is pivotably attachable to the primary support attachment frame (e.g. 22). Additionally, the directional boring attachment 20 of FIGS. 18*a*–18*c* contains a different support mechanism.

From an operational and functional standpoint, the directional boring attachment 20 includes generally fewer parts, and is lighter than the directional boring attachment 20 shown in FIG. 1. This lightness can be especially valuable when the directional boring attachment 220 is used with a skid loader, such as skid loader 200, as the largest number of skid loaders 200 that are manufactured today are relatively small, compact devices that are significantly smaller than traditional power shovel excavators (FIG. 1), bull dozers 100, power shovels 150, and other heavy duty earth-working equipment. As these Bobcat® type skid loaders are smaller, they generally have a smaller load capacity than the larger pieces of equipment, thus making the relatively lighter weight directional boring attachment 220 shown in FIGS. 18*a*–18*c* especially while suited to these smaller skid loaders.

Turning now to FIGS. 18*a*–18*c,* three different mounting arrangements are shown for mounting the directional boring attachment 220 to the skid loader 200. It will be appreciated that the skid loader 220 is generally similar to its fellow embodiments, as it is powered, operated and moved by a totally separate, and separable carrier, here, skid loader 200. The skid loader 220 is preferably powered by the hydraulic system of the separate carrier, such as skid loader 200, and moved by the hydraulic cylinders and transmission systems of the skid loader 200. Depending on the requirements of the directional boring attachment 220 and the capacity of the hydraulic system of the skid loader 200, the hydraulic system of the skid loader (or electrical system if electrically powered) may need to be upgraded with larger hydraulic pumps, additional hydraulic pumps, additional regulating equipment, additional batteries, electrical generating equipment (if electrically powered), and additional electrical or hydraulic motive parts, such as electric motors, gear reduction motors (for an electrically operated boring attachments), or hydraulic cylinders (for hydraulically operated directional boring equipment). As is typical of most skid loaders 200, the hydraulic components of the skid loader 200 include installed tees, valves, quick couplers and additional links of hydraulic lines that facilitate coupling the hydraulic system of the skid loader 200 to the directional boring equipment 220. Further, the transmission components include an engine, clutch, transmission, drive axles and wheels or tracks.

In addition to being powered by the hydraulic system of the skid loader 200, the directional boring attachment 220 may alternatively be powered by a power take off unit of the skid loader, or engine shaft of the skid loader 200, if such is provided as part of the skid loader 200.

The directional boring attachment 220 shown in FIGS. 18*a*–18*c* includes a directional boring attachment frame 222, that includes an integral, and fixedly attached supporting frame 219 for its bottom. The supporting frame portion 219 of the attachment frame 222 is the primary weight-supporting unit, for supporting the weight of the drill tools 221, including the drill stems 38. Other members of the boring attachment frame 222, such as vertically extending members 223, and laterally extending members 224 provide additional rigidity and strength to the boring attachment frame 222, and help to position the drill stems 236 on the attachment frame 222.

The boring attachment frame 222 also includes a control panel 232 disposed near the forward end of the device. As shown in FIG. 18*a,* the control panel 232 includes a plurality of levers 228 for operating the device. Additionally, a plurality of gauges (not shown) or other instrument readouts (not shown) can be provided.

As best shown in FIG. 18*a,* the supporting structure for supporting the support frame 219 and attachment frame 222 at a proper angle relative to the ground comprises a pair of relatively rearwardly disposed telescoping support legs 226 that are pivotably mounted to the supporting frame 219 at pivot point 230. Similar to leg 226 of the embodiment shown in FIG. 1, the support leg 230 is movable between a ground-engaging position, as shown in FIG. 18, and a storage position wherein the leg 226 is positioned generally parallel to supporting frame 219. It will be noted that support leg 226 is a two-piece leg having a lower portion that is sized and configured to be received interiorly, and moved telescopically within the upper portion of the leg 226.

A plurality of apertures, e.g. 234, are formed in the lower leg portion, that are alignable with an aperture 235 of the upper leg portion, and through which a pin or detent means can be inserted to lockingly engage the relative axial positions of the bottom and top portion of the leg 226. Through this mechanism, the length of leg 226 can be adjusted, so that the attack angle of the boring attachment 220 can be adjusted properly by the user.

A generally triangular (in cross-section) frontal support frame 227 is disposed under the relatively forward portion of the supporting frame 219, for supporting the front portion of the attachment frame 222 in a desired spatial and angular relationship to the ground. The triangular support frame 227 includes a ground-engaging leg 231 that is designed to rest on the ground or other surface, an upstanding, vertically disposed leg 229, and a hypotenuse leg 233, that extends generally under, and parallel to the supporting frame 219. If desired, vertical leg 229 can have an adjustable length, to enable the attack angle of the boring attachment 220 to be varied by the user.

Additionally, one of the structural members of the attachment frame 222 can be fixedly or pivotably coupled to the link arm 211 of the skid loader 200. This attachment between the link arm 211 and the boring attachment frame 222 will permit the user to adjust the angle of the attack of the drill tool 221, to a desired attack angle. Additionally, by raising the link arm 211, the attachment between the link arm 211 and the attachment frame 222 would enable the user to lift the boring tool attachment 220 out upwardly, and out of engagement with the ground to better facilitate the movement of the boring attachment 220 from one location to another.

Turning now to FIG. 18*b,* it will be noted that the boring attachment 222 is shown being coupled to a skid loader 200, in an arrangement wherein the boring tool attachment 220 is generally disposed in front of, and transversely to the skid loader 200. In this arrangement, the attachment frame 222 can be fixedly or pivotably coupled to one or both of the lift arms 207 to be permit the user to move the boring attachment 220 upwardly, and out of engagement with the ground, and downwardly, to engage the ground, thereby facilitating movement of the device.

FIG. 18*c* represents a side view of the embodiment shown in FIG. 18*b*. It should be noted that the auger assembly 51 for securing the boring attachment 220 to the ground comprises a pair of spaced augers 51. Due to the view from which the other drawings are taken, the existence of these two augers may not be clearly represented in the other drawings, and their description. However, the dual auger arrangement shown in FIG. 18*c* is a preferred arrangement for all of the auger containing boring attachments of the present invention. As also illustrated in FIG. 18*c,* a side mounted mounting bracket 237 is provided for attaching the attachment frame 222 to the lift arm 207 of the skid loader 200, for facilitating the lifting and movement of the boring attachment 220 by the skid loader 200.

FIGS. 19–20 illustrate examples of coupling the exemplary ground rest-able directional boring attachment 20 to a backhoe loader 250. The directional boring attachment 20 in FIGS. 19–20 is identical generally to the one shown in FIG. 1, and is primarily powered, operated and moved by the backhoe loader 250, and is preferably powered by the hydraulic system of the backhoe loader 250. Depending upon the requirements of the directional boring attachment 20 and the capacity of the hydraulic system of the backhoe loader 250, the hydraulic system may need to be upgraded with larger hydraulic pumps, additional hydraulic pumps, and/or regulated to operate the existing equipment of the backhoe loader 250 and the attached directional boring attachment 20. As is typical of most backhoe loaders, the hydraulic lines of the backhoe loader 250 include installed tees, valves, quick couplers, and additional lengths of hydraulic lines that facilitate coupling the hydraulic system of the backhoe loader 250 to the directional boring attachment 20.

Besides being powered by the hydraulic system of the backhoe loader 250, the directional boring attachment 20 may alternatively be powered by a power take-off (P.T.O.) of the backhoe loader 250 and/or engine shaft located underneath, behind, or in front of the backhoe loader 250. The directional boring attachment 20 may also be powered by batteries, generators, and/or alternators of the existing electrical system of the backhoe loader 250 and regulated as needed. Depending upon the requirements of the directional boring attachment 20 and the capacity of the existing electrical system of the backhoe loader 250, the electrical system may need to be upgraded with larger batteries, additional batteries, additional alternators, larger alternators, and/or regulated to operate existing equipment of the backhoe loader 250 and directional boring attachment 20.

In an exemplary embodiment, the directional boring tool 21 and the other controllable components of the directional boring attachment 20 are operated by a control panel 32 (similar to FIG. 1 or FIG. 18*a*) mounted in the existing cab 260 of the backhoe loader 250 and operatively coupled to the directional boring attachment 20 via a wired and/or wireless communications link. Alternatively, the control panel 32 may be mounted on the directional boring attachment 20 similarly to that shown in FIGS. 1 and 18*a,* or incorporated into a portable remote unit that is operatively coupled to the directional boring attachment 20 via a wired and/or wireless communications link.

In the embodiment shown in FIG. 19, the bucket or blade 252 of the backhoe loader 250 is unpinned and removed at a pivot point 254. The directional boring attachment 20 is pivotably attached by a pivot pin to the pivot point 254 by the extendable/retractable coupler 33, that includes a pivot bracket 255 attached thereto. As backhoe loaders generally do not have standardized parts, the attachment frame 22 and for supporting frame 19 of the directional boring attachment 20 may need custom fitting and/or fabrication for each type of backhoe loader that the directional boring attachment 20 is to be coupled to in this manner. More specifically, the dimensional parameters of the attachment frame 22 such as pin placement and pin size depend upon: (1) the dimensions of the backhoe loader 250; (2) the size, dimensions, and weight of the directional boring tool 21; (3) clearance requirements of the backhoe loader 250 and the directional boring tool 21; and (4) the angles of attack supported by the directional boring tool 21.

Instead of being pivotably coupled by a pivot pin to the pivot point 254 of the backhoe loader 250, the attachment frame 22 may be bolted and/or welded to the pivot point 254. In an exemplary embodiment, the hydraulic cylinders 256 for the bucket/or blade 252 are pivotably coupled to a mounting bracket 257 of the attachment frame 22 in order to provide a mechanism by which to control the angle of attack for the directional boring tool 21. Furthermore, as depicted in FIG. 20, the first stabilizer assembly 26 may be locked into its ground engaging position and the wheel assembly 24 extended downward to provide further support for the directional boring attachment 20 during operation, thus relieving the backhoe loader 250 of total support responsibilities.

FIG. 20 illustrates another mechanism for attaching the directional boring attachment 20 to a backhoe loader 250. As illustrated, the extendable/retractable coupler 33 at the back end of the attachment frame 22 is attached to a hitch member 259, that is coupled to the main undercarriage of the backhoe loader 250. In an exemplary embodiment, existing hydraulic cylinders (not shown) under the backhoe loader 250 are pivotably coupled to the attachment frame 22 in order to provide a mechanism for controlling the angle of attack of the directional boring tool 21. Again, the specific size of attachment plates, sleeves, and locations will vary according to the size of the backhoe loader 250, the size and configuration of the direction boring attachment, and the angles of attack supported by the directional boring tool 21. Furthermore, as depicted, the first stabilizer assembly 26 may be locked into its ground-engaging position and the wheel assembly 24 lowered to provide further support for the directional boring attachment 20 during operation.

FIG. 21 illustrates an example of coupling the exemplary direction boring attachment 20 to an agricultural tractor 300. The directional boring attachment 20 in FIG. 300 is generally similar to the boring attachment 20 of FIG. 1, and is primarily powered, operated and moved by the agricultural tractor 300, and, in particular, by the hydraulic system of the agricultural tractor 300. Depending upon the requirements of the directional boring attachment 20 and the capacity of the hydraulic system of the agricultural tractor 300, the hydraulic system may need to be upgraded with larger hydraulic pumps, additional hydraulic pumps, and/or regulated to operate the existing equipment of the agricultural tractor 300 and the attached directional boring attachment 20. The hydraulic lines of the agricultural tractor 300 (as is typical of most agricultural tractors) include installed tees, valves, quick couplers, and additional lengths of hydraulic lines that facilitate coupling the hydraulic system of the agricultural tractor 300 to the directional boring attachment 20.

Besides being powered by the hydraulic system of the agricultural tractor 300, the directional boring attachment 20 may alternatively be powered by a power take-off (P.T.O.) of the agricultural tractor 300 and/or engine shaft located underneath, behind, or in front of the agricultural tractor 300. The directional boring attachment 20 may also be powered by batteries, generators, and/or alternators of the existing electrical system of the agricultural tractor 300. Depending upon the requirements of the directional boring attachment 20 and the capacity of the existing electrical system of the agricultural tractor 300, the electrical system may need to be upgraded with additional batteries, larger batteries, additional alternators, larger alternators, and/or regulated to operate existing equipment of the agricultural tractor 300 and the directional boring attachment 20.

In an exemplary embodiment, the directional boring tool 21 and the other controllable components of the directional boring attachment 20 are operated by a control panel (not shown) which may be similar to control panel 32 of FIG. 1, or control panel 232 of FIG. 18*a,* and that can be mounted to the existing cab of the agricultural tractor 300 and operatively coupled to the directional boring attachment 20 via a wired and/or wireless communications link alternatively, the control panel 32 may be mounted upon the directional boring attachment 20 or incorporated into a portable remote unit that are operatively coupled to the directional boring attachment 20 via a wired and/or wireless communications link.

In FIG. 21, the back end of the attachment frame 22 is attached to the main undercarriage of the agricultural tractor 300 by a hitch member 307 that is disposed at the end of the extendable/retractable coupler 33; and existing hydraulic cylinders (not shown) under the agricultural tractor 300 are pivotably coupled to the attachment frame 22 in order to provide a mechanism by which to control the angle of attack of the directional boring tool 21. Again, the specific size of attachment plates, sleeves, and locations will vary according to the size of the agricultural tractor 300, the size of the direction boring attachment, and the angles of attack supported by the directional boring tool 21. Furthermore, as depicted, the first stabilizer assembly 26 may be locked into its ground engaging position, and the wheel assembly 24 lowered to provide further support for the directional boring attachment 20 during operation.

FIG. 22 illustrates an embodiment wherein the exemplary direction boring attachment 20 is coupled to a powered industrial truck/forklift 350. In general, the directional boring attachment 20 in FIG. 22 is powered, operated and moved by the power industrial truck/forklift 350, and in particular, by the hydraulic and/or pneumatic system of the power industrial truck/forklift 350. Depending upon the requirements of the directional boring attachment 20 and the capacity of the hydraulic system of the power industrial truck/forklift 350, the hydraulic system may need to be upgraded with larger hydraulic pumps, additional hydraulic pumps, and/or regulated to operate the existing equipment of the power industrial truck/forklift 350 and the attached directional boring attachment 20. As is typical of most power industrial truck/forklifts, the hydraulic lines of the power industrial truck/forklift 350, include installed tees, valves, quick couplers, and additional lengths of hydraulic lines that facilitate coupling the hydraulic system of the power industrial truck/forklift 350 to the directional boring attachment 20.

Besides being powered by the hydraulic system of the power industrial truck/forklift 350, the directional boring attachment 20 may alternatively be powered by a power take-off (P.T.O.) of the power industrial truck/forklift 350 and/or engine shaft located underneath, behind, or in front of the power industrial truck/forklift 350. The directional boring attachment 20 may also be powered by the batteries, generators, and/or alternators of the existing electrical system of the power industrial truck/forklift 350. Depending upon the requirements of the directional boring attachment 20 and the capacity of the existing electrical system of the power industrial truck/forklift 350, the electrical system may need to be upgraded with additional batteries, larger batteries, additional alternators, larger alternators, and/or regulated to operate existing equipment of the power industrial truck/forklift 350 and the directional boring attachment 20.

In an exemplary embodiment, the directional boring tool 21 and the other controllable components of the directional boring attachment 20 are operated by the control panel 332, similar to control panels 232 or 32, that is mounted in the existing cab of the power industrial truck/forklift 350 and operatively coupled to the directional boring attachment 20 via a wired and/or wireless communications link. Alternatively, the control panel 32 may be mounted upon the directional boring attachment 20 or incorporated into a portable remote unit that are operatively coupled to the directional boring attachment 20 via a wired and/or wireless communications link.

As illustrated in FIG. 22, the attachment frame 22 includes insertion slots 355 that slidably receive and engage the forks 352 of the powered industrial truck/forklift 350, to thereby couple the fork lift 350 to the attachment frame 22. By engaging the supporting frame 19 of the attachment frame 22 with the forks 352, the powered industrial truck/forklift 350 is operable to pick up and lift the entire directional boring attachment 20 in the same way that it normally lifts a pallet. In an exemplary embodiment, the supporting frame is pinned through the forks 352, and the attachment frame 22 may be chained to the body of the powered industrial truck/forklift 350. Alternately, the fork 352 of the forklift can be chained to a rearwardly mounted mounting bracket (not shown). Again, the specific size of attachment plates, sleeves, and locations will vary according to the size of the powered industrial truck/forklift 350, the size of the directional boring attachment 20, and the angles of attack supported by the directional boring tool 21. Furthermore, as depicted, the first stabilizer assembly 26 may be locked into its ground-engaging position and the wheel assembly 24 lowered to provide further support for the directional boring attachment 20 during operation.

FIG. 23 illustrates the direction boring attachment 20 being coupled to, and primarily powered by a trencher 400. In an exemplary embodiment, the directional boring attachment 20 is powered by the hydraulic system of the trencher 400. Depending upon the requirements of the directional boring attachment 20 and the capacity of the hydraulic system of the trencher 400, the hydraulic system may need to be upgraded with larger hydraulic pumps, additional hydraulic pumps, and/or regulated to operate the existing equipment of the trencher 400 and the attached directional boring attachment 20. As is typical of most trenchers, the hydraulic lines of the trencher 400, include installed tees, valves, quick couplers, and additional lengths of hydraulic lines that facilitate coupling the hydraulic system of the trencher 400 to the directional boring attachment 20.

Besides being powered by the hydraulic system of the trencher 400, the directional boring attachment 20 may alternatively be powered by a power take-off (P.T.O.) of the trencher 400 and/or engine shaft located underneath, behind, or in front of the trencher 400. The directional boring attachment 20 may also be powered by batteries, generators, and/or alternators of the existing electrical system of the trencher 400 and regulated as needed. Depending upon the requirements of the directional boring attachment 20 and the capacity of the existing electrical system of the trencher 400, the electrical system may need to be upgraded with larger batteries, additional batteries, additional alternators, larger alternators, and/or regulated to operate existing equipment of the trencher 400 and directional boring attachment 20.

In the embodiment shown, directional boring tool 21 and the other controllable components of the directional boring attachment 20 are operated by the control panel (not shown) that can be mounted in the existing cab of the trencher 400 and operatively coupled to the directional boring attachment 20 via a wired and/or wireless communications link.

Alternatively, the control panel may be mounted upon the directional boring attachment 20 or incorporated into a portable remote unit that are operatively coupled to the directional boring attachment 20 via a wired and/or wireless communications link.

In one embodiment, the trenching tool 402 or backfill blade (not shown) that is attached to powered arm 404 of the trencher 400 is unpinned from coupling point 405 and removed. The directional boring attachment 20 is then pivotably coupled via the extendable/retractable coupler 33 to the undercarriage of the trencher 400 or to the point at which either the trenching tool 402 or backfill blade 404 is removed. As trenchers generally do not have standardized parts, the attachment frame 22 of the directional boring attachment 20 may need custom fitting and/or fabrication for each type of trencher that the directional boring attachment 20 is to be coupled to in this manner. More specifically, the dimensional parameters of the attachment frame 22 such as pin placement and pin size depend upon: (1) the dimensions of the trencher 400; (2) the size, dimensions, and weight of the directional boring tool 21; (3) clearance requirements of the trencher 400 and the directional boring tool 21; and (4) the angles of attack supported by the directional boring tool 21.

Instead of being pivotably coupled to the trencher 400, the attachment frame 22 may be bolted and/or welded to the trencher 400. In one embodiment, the hydraulic cylinders (not shown) for the trenching tool 402 or the backfill blade 404 are pivotably coupled to the attachment frame 22 in order to provide a mechanism by which to control the angle of attack for the directional boring tool 21. Furthermore, as depicted in FIG. 23, the first stabilizer assembly 26 may be locked into its ground-engaging position and the wheel assembly 24 extended downward to provide further support for the directional boring attachment 20 during operation, thus relieving the trencher 400 of total support responsibilities.

FIGS. 24*a* and 24*b* illustrate the direction boring attachment 420 being coupled to a vehicle such as a truck 450. The directional boring attachment in FIGS. 24*a* and 24*b* is generally similar to directional boring attachment 20, except that the supporting frame 419 is either fixedly coupled to the truck bed and/or bed frame; or else the supporting frame 419 is a part of the truckbed and/or frame. The boring attachment 420 is powered, operated and moved by the power system of the truck 450, and in particular, is powered by the hydraulic and/or pneumatic system of the truck 450.

Depending upon the requirements of the directional boring attachment 420 and the capacity of the hydraulic system of the truck 450, the hydraulic system may need to be upgraded with larger hydraulic pumps, additional hydraulic pumps, and/or regulated to operate the existing equipment of the truck 450 and the attached directional boring attachment 420. As is typical of most trucks, the hydraulic lines of the truck 450 include various hydraulic components such as installed tees, valves, quick couplers, and additional lengths of hydraulic lines that facilitate coupling the hydraulic system of the truck 450 to the directional boring attachment 420.

In lieu of being powered by the hydraulic system of the vehicle/truck 450, the directional boring attachment 420 may be powered by a power take-off (P.T.O.) of the truck 450 and/or the vehicle's engine shaft. The directional boring attachment 420 may also be powered by batteries, alternators, and/or generators of the existing electrical system of the truck 450. Depending upon the requirements of the directional boring attachment 420 and the capacity of the existing electrical system of the truck 450, the electrical system may need to be upgraded with additional batteries, larger batteries, additional alternators, larger alternators, and/or regulated to operate the existing equipment of the vehicle/truck 450 and the directional boring attachment 420.

In an exemplary embodiment, the directional boring tool 421 and the other controllable components of the directional boring attachment 420 are operated by a control panel (not shown) mounted in the existing cab of the truck 450 and operatively coupled to the directional boring attachment 420 via a wired and/or wireless communications link. Alternatively, the control panel (not shown) may be mounted upon the attachment frame 422 of the directional boring attachment 420 or incorporated into a portable remote unit that is operatively coupled to the directional boring attachment 420 via a wired and/or wireless communications link.

One way in which the directional boring attachment 420 may be attached to the truck 450 is to fixedly couple the attachment frame 422 to the main frame of the truck 450 via the extendable/retractable coupler 33, and other points of the supporting frame 419. The attachment frame 422 of the directional boring attachment 420 may need custom fitting for each type of truck 450 that the directional boring attachment 420 is to be coupled to in this manner. More specifically, the dimensional parameters of the attachment frame 422 such as pin placement and pin size depend upon: (1) the dimensions of the truck 450; (2) the size, dimensions, and weight of the directional boring tool 421; (3) clearance requirements of the truck 450 and the directional boring tool 421; and (4) the angles of attack supported by the directional boring tool 421. Additionally, the rear portion of a lower longitudinal member should be pivotably coupled to the supporting frame 419 to enable the device to pivotably tilt, in a manner similar to a dump type bed.

In an exemplary embodiment, the hydraulic lift cylinders 452 of the vehicle/truck 450 are pivotably coupled to the attachment frame 422 in order to provide a mechanism for controlling the angle of attack for the directional boring tool 421. Furthermore, the first stabilizer assembly 26 may be locked into its ground-engaging position, and the wheel assembly 24 extended downward to provide further support for the directional boring attachment 420 during operation, thus relieving the backhoe loader 250 of total support responsibilities.

A second way for attaching the directional boring attachment to the truck 450 is to pin the attachment frame 22 to the tilt bed of the truck 450. Instead of being pinned to the tilt bed of 10 the truck 450, the attachment frame 422 may be bolted and/or welded to the tilt bed of the truck 450. The tilt bed provides a mechanism for controlling the angle of attack for the directional boring tool 21.

A third means for attaching the directional boring attachment to the truck 450 is to fixedly couple the attachment frame 422 to an isolated center section (not shown) of a flat bed that tilts. Again, instead of pinning the attachment frame 422 to the center section of the flat bed, the attachment flame 422 may be bolted and/or welded to the center section of the flat bed In an exemplary embodiment, the surrounding section of flat bed remains immovable as the center section tilts to afford some angle of attack for the directional boring tool 421, thus providing a flat working surface for the operator of the directional boring tool 421. The center section may further include guardrails (not shown) around the direction boring tool 421 and the perimeter of the flat bed to protect the operator of the directional boring tool 421 from injury. The specific size of attachment plates, sleeves, and locations will vary according to the size of the truck 450, the size of the directional boring tool 421, and the supported angles of attack. A hydraulic cylinder under the directional boring tool 421 would generally be attached to the secondary attachment frame to perform angle of attack adjustments, In some cases, additional screw type jack supports may be added between the truck's main frame and the frame of the tilt bed to maintain stability and rigidity.

FIG. 25 illustrates an example of the directional boring attachment 20 (similar or identical to the boring attachment 20 of FIG. 1) being coupled to a road grader 500. The directional boring attachment 20 in FIG. 25 is powered, operated and moved primarily by the road grader 500, and in particular by the hydraulic and/or pneumatic system of the road grader 500. Depending upon the requirements of the directional boring attachment 20 and the capacity of the hydraulic system of the road grader 500, the hydraulic system may need to be upgraded with larger hydraulic pumps, additional hydraulic pumps, and/or regulated to operate the existing equipment of the road grader 500 and the attached directional boring attachment 20. The hydraulic lines of the road grader 500 include installed hydraulic fluid carriers and fluid flow controllers such as tees, valves, quick couplers, and additional lengths of hydraulic lines that facilitate coupling the hydraulic system of the road grader 500 to the directional boring attachment 20.

Besides being powered by the hydraulic system of the road grader 500, the directional boring attachment 20 may alternatively be powered by a power take-off (P.T.O.) of the road grader 500 and/or engine shaft. The directional boring attachment 20 may also be powered by batteries, alternators, and/or generators of the existing or supplemental electrical system of the road grader 500.

In an exemplary embodiment, the directional boring tool 21 and the controllable components of the directional boring attachment 20 are operated by a control panel mounted either in the existing cab of the road grader 500 or upon the directional boring attachment 20, or incorporated into a portable remote unit that is operatively coupled to the directional boring attachment 20 via a wired and/or wireless communications link As illustrated in FIG. 25, the road grader's 500 front blade is unpinned and removed from blade connection member 507. The attachment frame 22 is then pivotably coupled to connection member 507. As road graders generally do not have standardized parts, the attachment frame 22 may need to be custom fitted and/or fabricated for each type of road grader that the directional boring attachment 20 is to be coupled to in this manner. More specifically, the dimensional parameters of the attachment frame 22 such as pin placement and pin size depend upon: (1) the dimensions of the road grader 500; (2) the size, dimensions, and weight of the directional boring tool 21; (3) clearance requirements of the road grader 500 and the directional boring tool 21; and (4) the angles of attack supported by the directional boring tool 21.

Instead of being pivotably coupled to the road grader 500, the attachment frame 22 may be bolted and/or welded to the road grader 500. In an exemplary embodiment, the hydraulic cylinders (not shown) for the front blade are pinned to the attachment frame 22 in order to provide a mechanism by which the angle of attack may be adjusted. Furthermore, the first stabilizer assembly 26 may be locked into its ground-engaging position and the wheel assembly 24 extended downward to provide further support for the directional boring attachment 20 during operation, thus relieving the road grader 500 of total support and stress absorbing responsibilities.

FIG. 26 illustrates the exemplary direction boring attachment 20 being coupled to a roller compactor 550. The directional boring attachment 20 in FIG. 26 is primarily powered, operated and moved by the roller compactor 550, and specifically by the hydraulic system of the roller compactor 550. Depending upon the requirements of the directional boring attachment 20 and the capacity of the hydraulic system of the roller compactor 550, the hydraulic system may a need to be upgraded with larger hydraulic pumps, additional hydraulic pumps, and/or regulated to operate the existing equipment of the roller compactor 550 and the attached directional boring attachment 20. The hydraulic lines of the roller compactor 550 include installed hydraulic system fluid carriers, connectors and fluid flow controllers, such as tees, valves, quick couplers, and additional lengths of hydraulic lines that facilitate coupling the hydraulic system of the roller compactor 550 to the directional boring attachment 20.

Besides being powered by the hydraulic system of the roller compactor 550, the directional boring attachment 20 may alternatively be powered by a power take-off (P.T.O.) of the roller compactor 550 and/or engine shaft located underneath, behind, or in front of the roller compactor 550. The directional boring attachment 20 may also be powered by batteries, alternators, and/or generators of the existing or supplemental electrical system of the roller compactor 550.

In an exemplary embodiment, the directional boring tool 21 and the other controllable components of the directional boring attachment 20 are operated by a control panel (not shown) that is either mounted at the existing cab of the roller compactor 550; mounted upon the directional boring attachment 20; or else is incorporated into a portable remote unit that is operatively coupled to the directional boring attachment 20 via a wired and/or wireless communications link.

To attach the directional boring attachment 20 to the roller compactor 550, the front dozer blade 552 of the roller compactor 550 is first unpinned and removed from attachment point 557. The attachment frame 22 is then pivotably coupled to attachment point 557, where the dozer blade was removed. As roller compactors generally do not have standardized parts, the attachment frame 22 may need to be custom fitted and/or fabricated for each type of road grader that the directional boring attachment 20 is to be coupled to in this manner.

Instead of being pivotably coupled to the roller compactor 550, the attachment frame 22 may be bolted and/or welded to the roller compactor 550. In an exemplary embodiment, the hydraulic cylinders (not shown) for the front blade 552 are pivotably coupled to the attachment frame 22 such as at attachment yoke 30 or else to a rear-positioned mounting bracket (not shown) in order to provide a mechanism by which the angle of attack may be adjusted.

While the invention has been illustrated and described in detail in the drawings and foregoing description, such illustration and description is to be considered as exemplary and not restrictive in character, it being understood that only exemplary embodiments have been shown and described and that all changes and modifications that come within the spirit of the invention are desired to be protected.

What is claimed:

1. A directional boring device for attachment to an existing non-boring device configured carrier having a power source for providing a first power supply to the boring device for positionally moving the device and a second power supply for operating the device, the boring device comprising (a) an attachment frame;

(b) a selectively attachable first coupler for coupling the attachment frame to the first power supply to permit the device to be positionally moved by the carrier; and (c) a drill tool assembly including:

(1) a drill head;

(2) a plurality of drill stems capable of being attached individually and in series to the drill head;

(3) a drill bit attachable to the drill stem; and (4) a drill assembly power transmission for imparting rotational and axial movement to the drill tool assembly whereby the drill assembly transmission is capable of moving the drill head and drill stem in a path generally parallel to the plane on which the carrier rests; and (d) a selectively attachable second coupler for coupling the second power supply to the drill assembly power transmission for permitting the carrier power source to supply power to the drill assembly power transmission to operate the drill tool assembly.

2. The device of claim 1 wherein the first power supply includes a hydraulic cylinder pivotably coupled to the attachment frame for positionally moving the directional boring device.

3. The device of claim 1 wherein the second power supply comprises a hydraulic fluid source, and the second coupler comprises a hydraulic fluid receiver for transporting hydraulic fluid to the drill assembly power transmission.

4. The device of claim 1 further comprising a ground-engaging member for fixedly positioning the boring attachment on the ground, wherein the second coupler includes a power receiver for permitting the power source to transmit power to the ground-engaging member.

5. The device of claim 1 wherein the first power supply comprises a hydraulic power supply, and the second power supply comprises a hydraulic power supply.

6. The device of claim 5, wherein the carrier is selected from the group consisting of a roller compacter, an excavators, a power shovel, a crane, a tracked vehicle, a dozer, a wheel loader, a skid loader, a back hoe, a tractor, a fork truck, a trencher, a truck, and a road grader.

7. The device of claim 1 wherein the attachment frame includes a ground-engaging member for capable of supporting the weight of the boring device on the ground, independently of the carrier.

8. The device of claim 7 wherein the ground-engaging member comprises a supporting frame and a ground engaging wheel set for permitting the carrier to to utilize the wheel set for aiding the carrier in positionally moving the device along the ground.

9. The device of claim 8 wherein the first power supply comprises a hydraulic cylinder actuated power supply coupled, though the first coupler to the boring device for positionally moving the boring device.

10. The device of claim 9 wherein the wheel set is pivotbaly removably coupled to the attachment frame, to permit the attachment frame to pivotably tilt about the wheel set, and to permit the wheel set to be removed from the attachment frame.

11. The device of claim 8 wherein the supporting frame is pivotably coupled to the attachment frame for permitting pivotal movement of the attachment frame relative to the supporting frame to vary the angle at which the drill head attacks the ground, and the ground engaging wheel set are coupled to the supporting frame.

12. The device of claim 11 wherein the hydraulic cylinder actuated power supply includes a lifting arm coupled, by the first coupler to the attachment frame for permitting the carrier to lift the boring device.

13. The device of claim 1 wherein the first power supply comprises a hydraulic cylinder actuated power supply coupled, though the first coupler to the boring device for positionally moving the boring device.

14. The device of claim 1 wherein the selectively attachable first coupler comprises an attachment yoke fixedly attached to the attachment frame.

15. The device of claim 14 wherein the attachment yoke includes an attachment mechanisms selected from the group consisting of pins, couplings, hitches, chains, and pivot points for permitting the attachment frame and the directional boring attachment device 20 to be attached to the carrier.

* * * * *